US010040303B2

(12) United States Patent
Takabatake et al.

(10) Patent No.: US 10,040,303 B2
(45) Date of Patent: Aug. 7, 2018

(54) PRINTER

(71) Applicant: FUJITSU COMPONENT LIMITED, Tokyo (JP)

(72) Inventors: Yoshinari Takabatake, Tokyo (JP); Sumio Watanabe, Tokyo (JP); Masahiro Tsuchiya, Tokyo (JP); Yuji Yada, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/555,855

(22) PCT Filed: Mar. 14, 2016

(86) PCT No.: PCT/JP2016/058026
§ 371 (c)(1),
(2) Date: Sep. 5, 2017

(87) PCT Pub. No.: WO2016/152629
PCT Pub. Date: Sep. 29, 2016

(65) Prior Publication Data

US 2018/0043713 A1 Feb. 15, 2018

(30) Foreign Application Priority Data

Mar. 20, 2015 (JP) ..... 2015-058726

(51) Int. Cl.
*B41J 29/13* (2006.01)
*B41J 29/02* (2006.01)

(52) U.S. Cl.
CPC ..... *B41J 29/02* (2013.01)

(58) Field of Classification Search
CPC ..... B41J 29/13; B41J 29/02
See application file for complete search history.

(56) References Cited

U.S. PATENT DOCUMENTS

2012/0257222 A1* 10/2012 Jiang ..... B41J 11/0075 358/1.5
2013/0164071 A1* 6/2013 Matsuya ..... B26D 7/22 400/621
2014/0186087 A1* 7/2014 Aizawa ..... B41J 11/66 400/621

FOREIGN PATENT DOCUMENTS

| | | |
|---|---|---|
| JP | S59-114660 U | 8/1984 |
| JP | 2009-096595 | 5/2009 |
| JP | 2016-052416 | 4/2016 |
| WO | 2013/140465 | 9/2013 |

* cited by examiner

*Primary Examiner* — Jason Uhlenhake
(74) *Attorney, Agent, or Firm* — IPUSA, PLLC

(57) ABSTRACT

A printer includes a printer body including a holder configured to house rolled recording paper, a cover configured to open and close the holder, a coupling mechanism that couples the cover to the printer body, and a detachment preventing mechanism configured to prevent the cover from being detached from the printer body. The coupling mechanism includes shafts formed on one of side plates of the cover and inner walls of the printer body, and shaft holes formed in another one of the side plates and the inner walls and configured to receive the shafts; and the detachment preventing mechanism includes a stopper that is disposed such that ends of the stopper contact inner surfaces of the side plates and configured to support the side plates and prevent the side plates from falling when a load is applied to the cover.

4 Claims, 28 Drawing Sheets

PRINTER

TECHNICAL FIELD

An aspect of this disclosure relates to a printer.

BACKGROUND ART

There is a known printer that includes a printer body including a holder for holding a recording paper roll and a cover rotatably supported by the printer body.

In a method of setting a recording paper roll in the holder, the core of the recording paper roll is attached to a paper-feed shaft of the paper holder. Also, drop-in-type printers are becoming popular. A drop-in-type printer is configured such that a recording paper roll can be easily placed in a holder without using a paper-feed shaft.

RELATED-ART DOCUMENTS

Patent Document

[Patent Document 1] Japanese Laid-Open Patent Publication No. 2009-096595

SUMMARY OF INVENTION

Technical Problem

Although a printer can be downsized, the size of recording paper does not change. When the thickness of the cover of such a downsized printer is reduced to house recording paper, the strength of the cover decreases, and the strength of a coupling mechanism for coupling the cover to the printer body also decreases. As a result, the cover may be decoupled by just placing recording paper on the cover.

In a drop-in-type printer, the cover is opened in a direction away from the printer body to place a recording paper roll in the holder. That is, it is necessary to carry the recording paper roll above the opened cover. For this reason, there is a high risk that the recording paper roll is dropped onto the opened cover, and the cover is detached due to the impact of the recording paper roll.

One object of this disclosure is to provide a printer with a configuration that can prevent detachment of a cover from a printer body.

Solution to Problem

In an aspect of this disclosure, there is provided a printer that includes a printer body including a holder configured to house rolled recording paper, a cover configured to open and close the holder, a coupling mechanism that couples the cover to the printer body, and a detachment preventing mechanism configured to prevent the cover from being detached from the printer body. The coupling mechanism includes shafts formed on one of side plates of the cover and inner walls of the printer body, and shaft holes formed in another one of the side plates and the inner walls and configured to receive the shafts; and the detachment preventing mechanism includes a stopper that is disposed such that ends of the stopper contact inner surfaces of the side plates and configured to support the side plates and prevent the side plates from falling when a load is applied to the cover.

Advantageous Effects of Invention

An aspect of this disclosure makes it possible to prevent detachment of a cover from a printer body.

DESCRIPTION OF EMBODIMENTS

Non-limiting embodiments of the present invention are described below with reference to the accompanying drawings.

Throughout the accompanying drawings, the same or corresponding reference numbers are assigned to the same or corresponding components, and repeated descriptions of those components are omitted. Unless otherwise mentioned, the drawings do not indicate relative sizes of components.

The embodiments described below are examples, and the present invention is not limited to those embodiments. Also, not all of the features and their combinations described in the embodiments may be essential to the present invention.

FIGS. 1 through 6B are drawings illustrating a printer 1A of a first embodiment.

Figure 1:
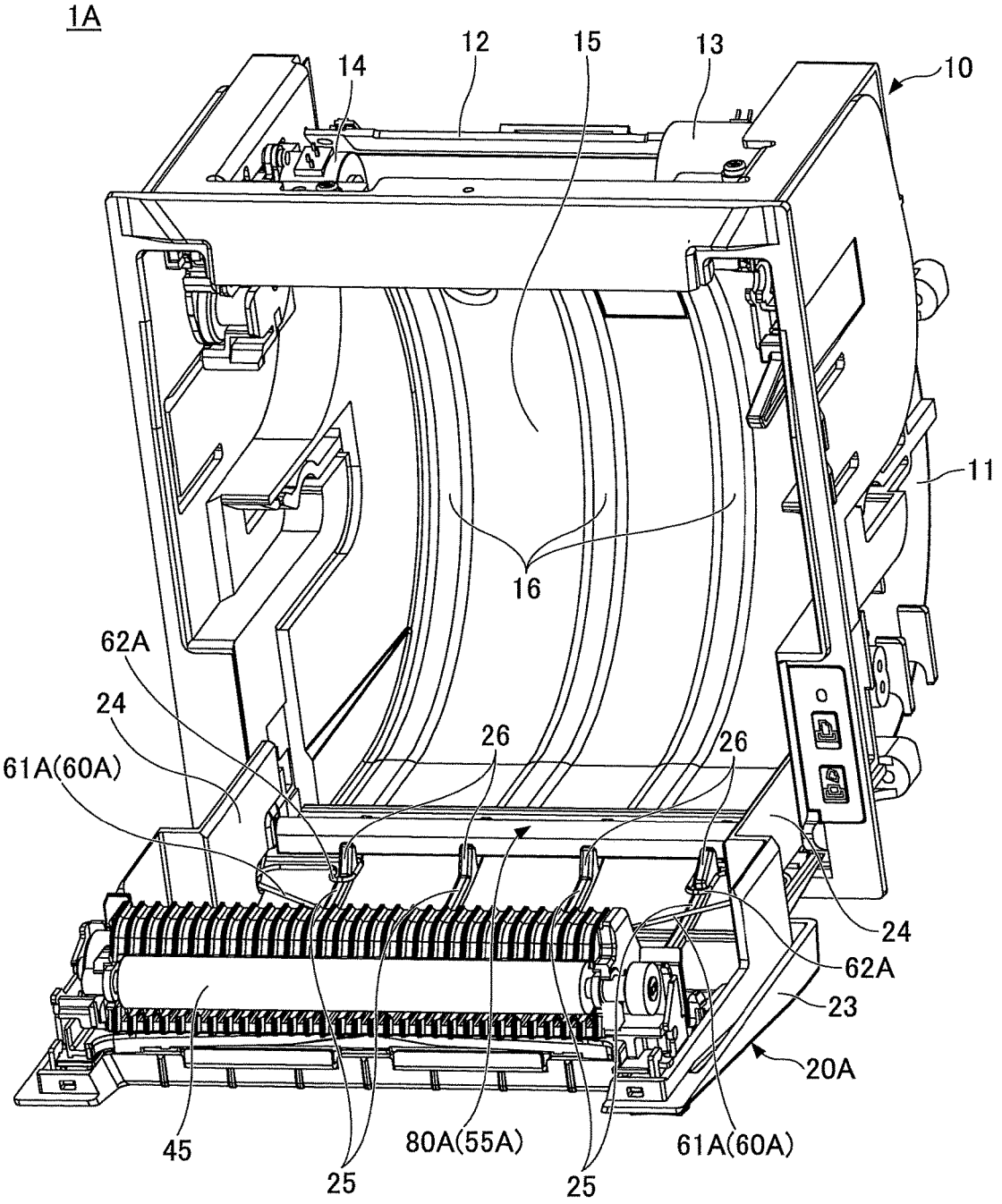
FIG. 1 is a perspective view of a printer whose cover is open according to a first embodiment.
Figure 2:
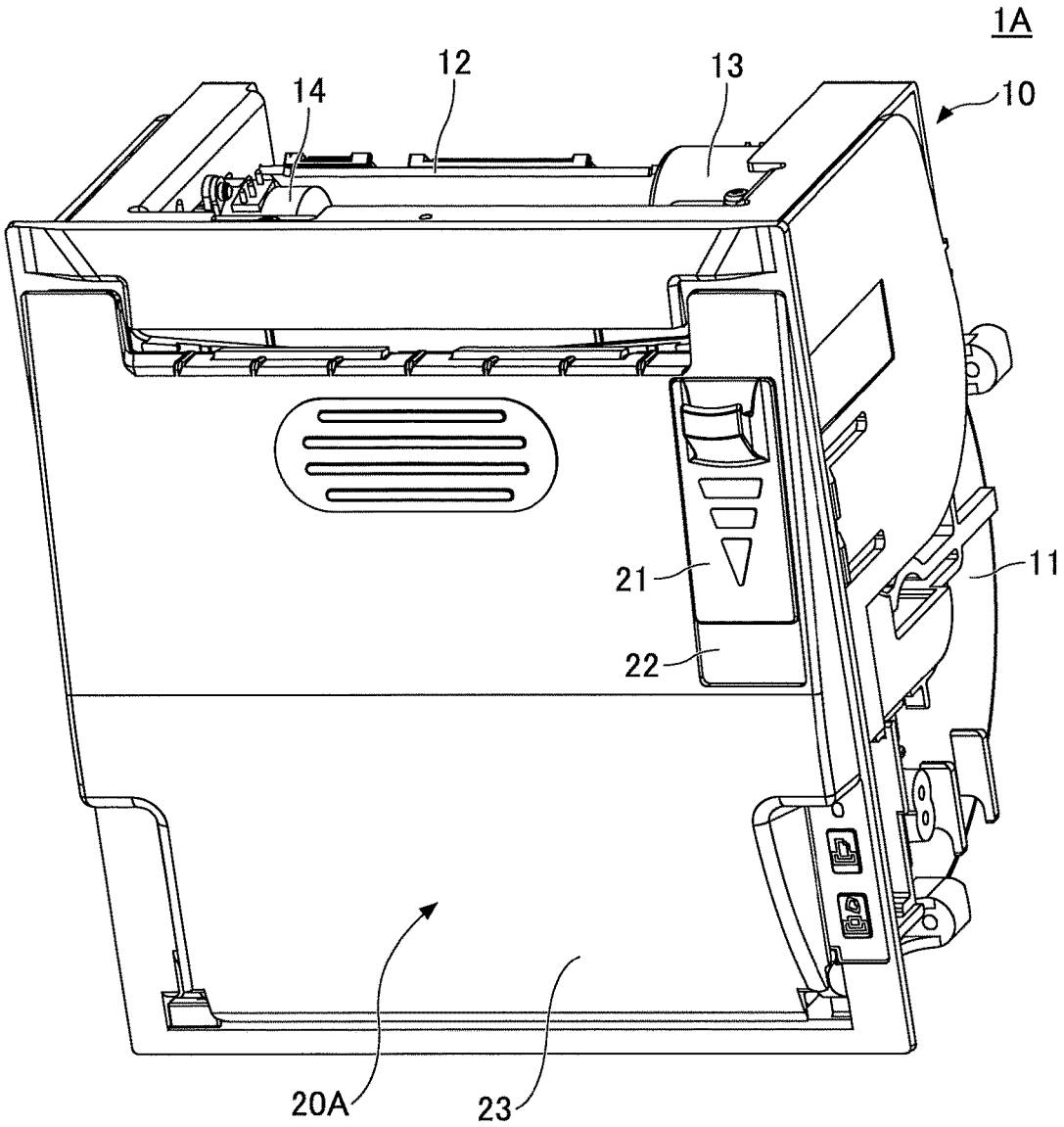
FIG. 2 is a perspective view of a printer whose cover is closed according to the first embodiment.
Figure 3:
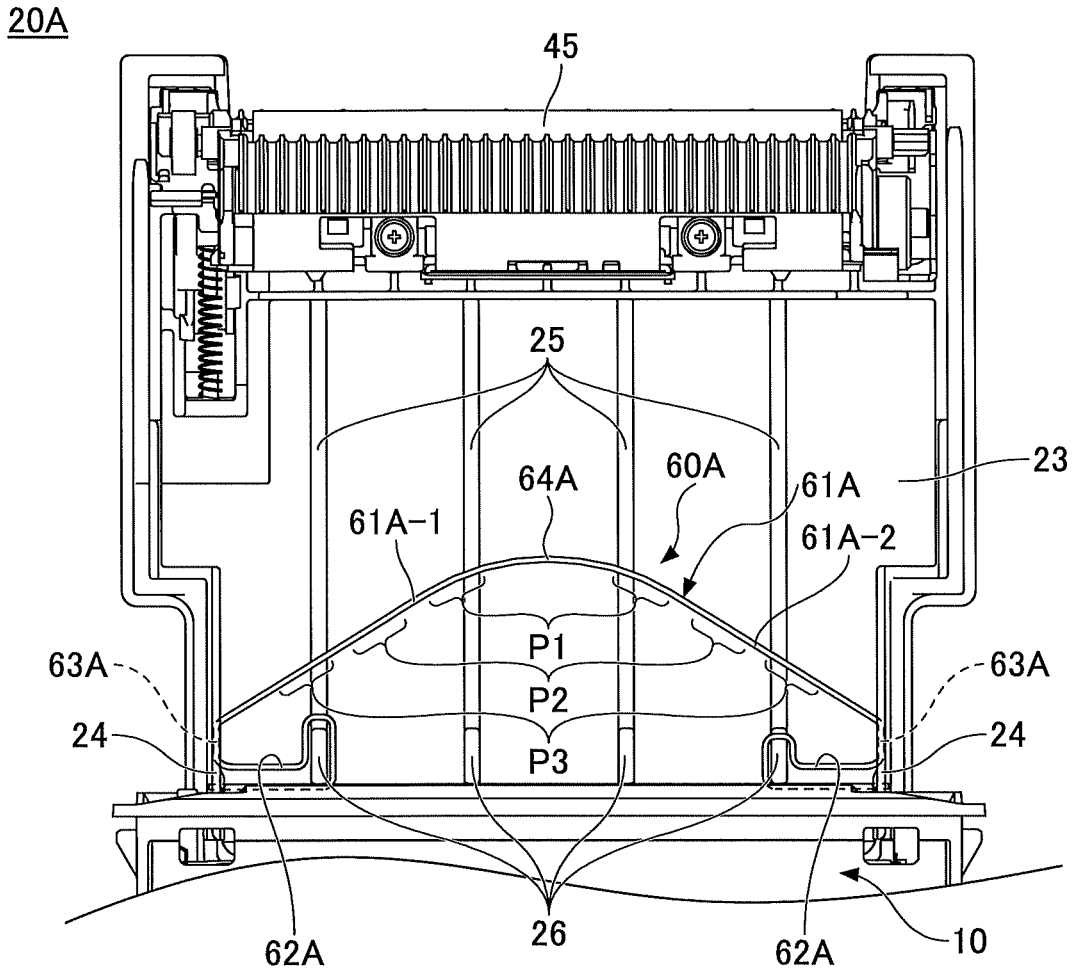
FIG. 3 is a plan view of a printer according to the first embodiment.
Figure 4:
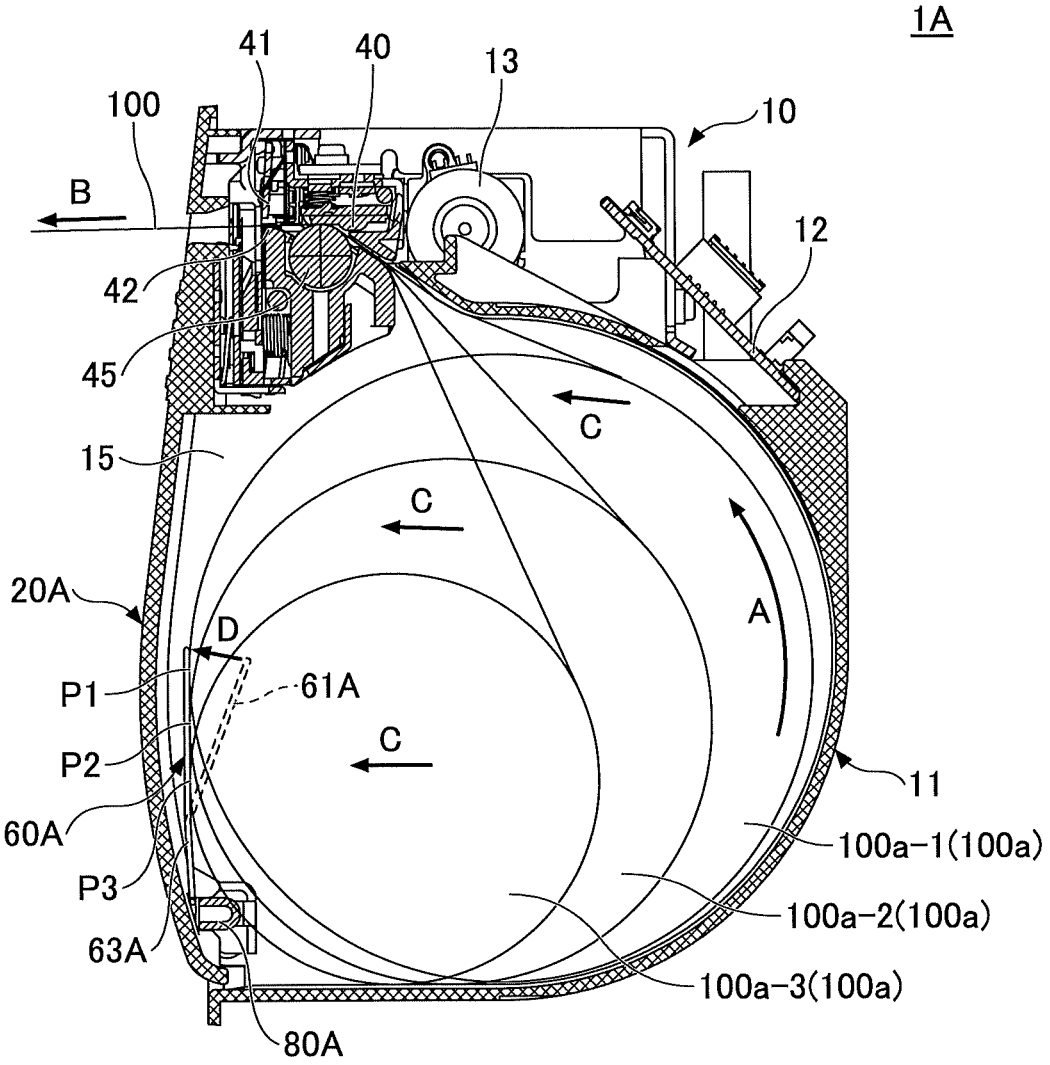
FIG. 4 is a cross-sectional view of a printer whose cover is closed according to the first embodiment.
Figure 5:
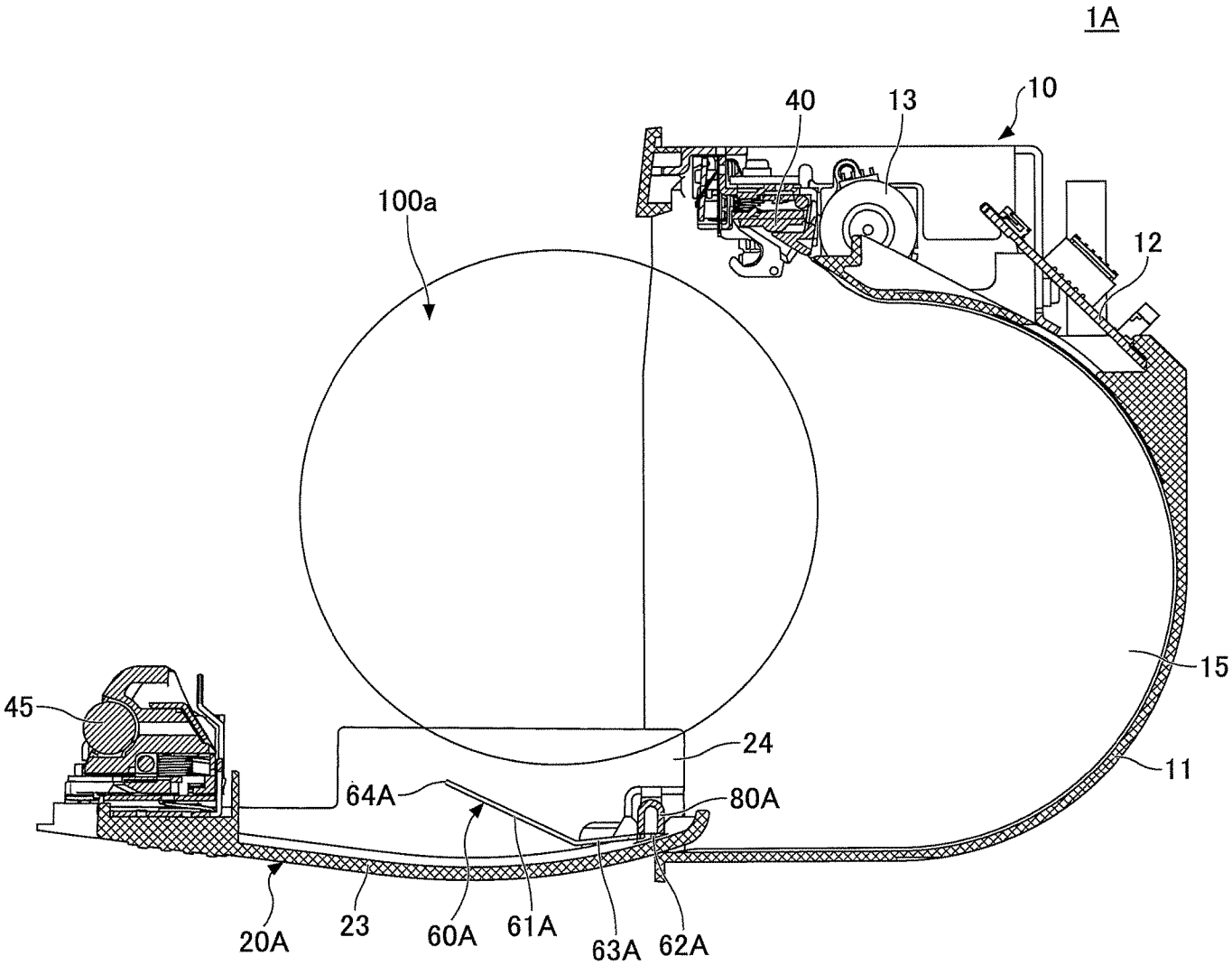
FIG. 5 is a cross-sectional view of a printer whose cover is open according to the first embodiment.
Figure 6A:
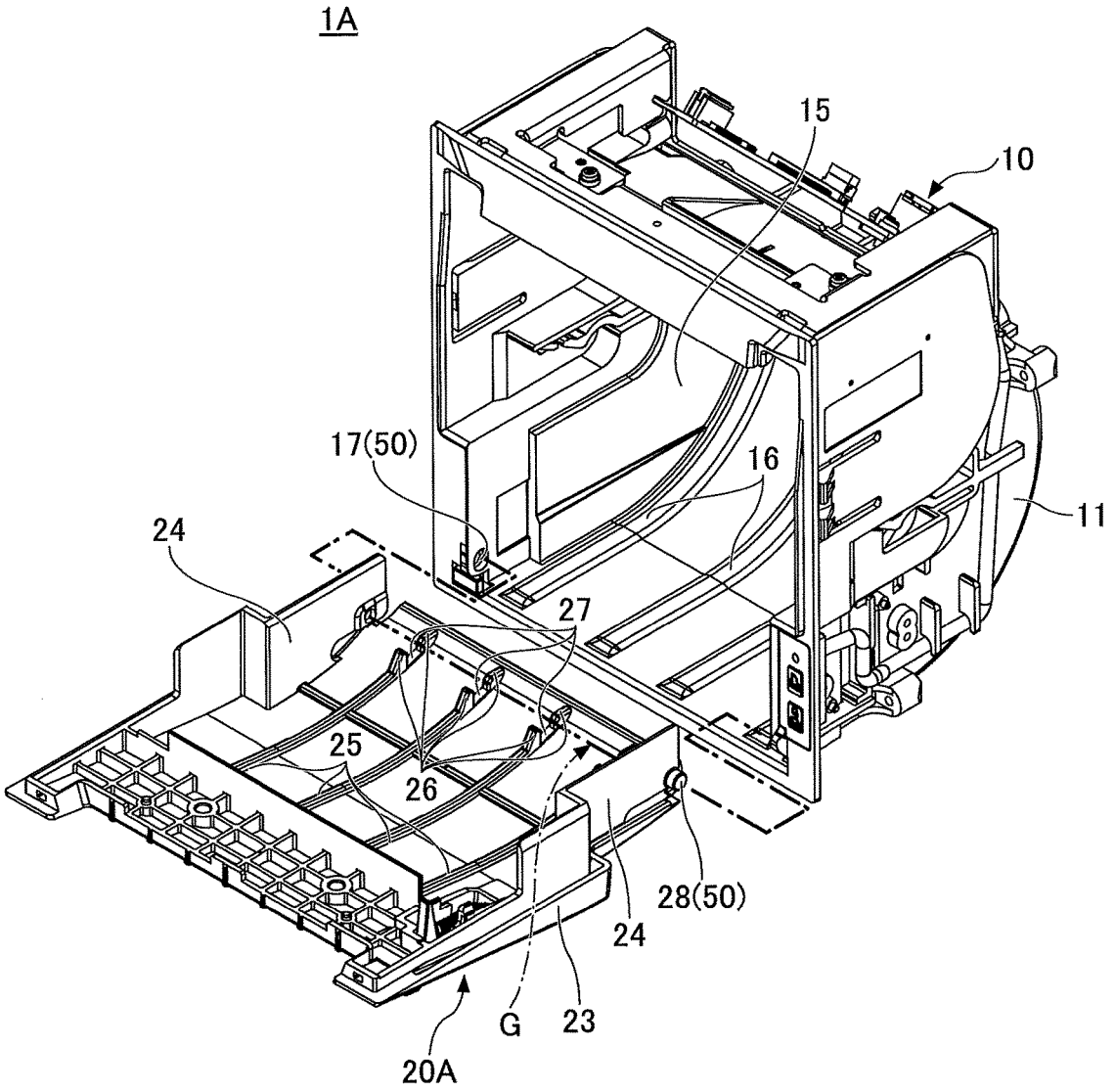
FIG. 6A is a perspective view of a printer whose cover is detached according to the first embodiment.
Figure 6B:
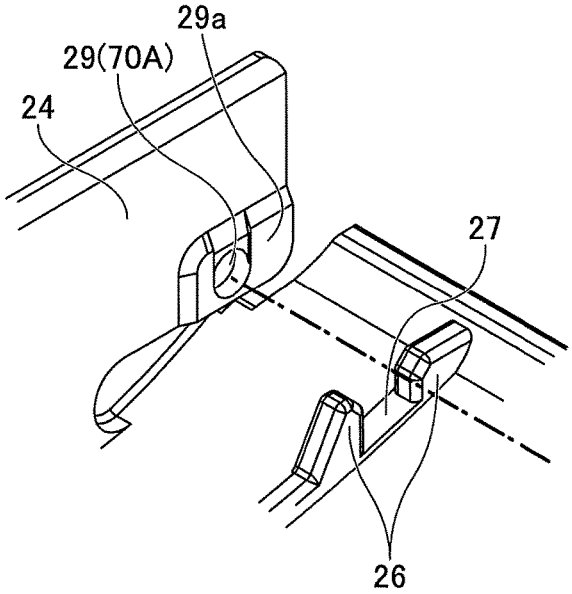
FIG. 6B is a partial enlarged view of a coupling mechanism of a printer according to the first embodiment.
Figure 7:
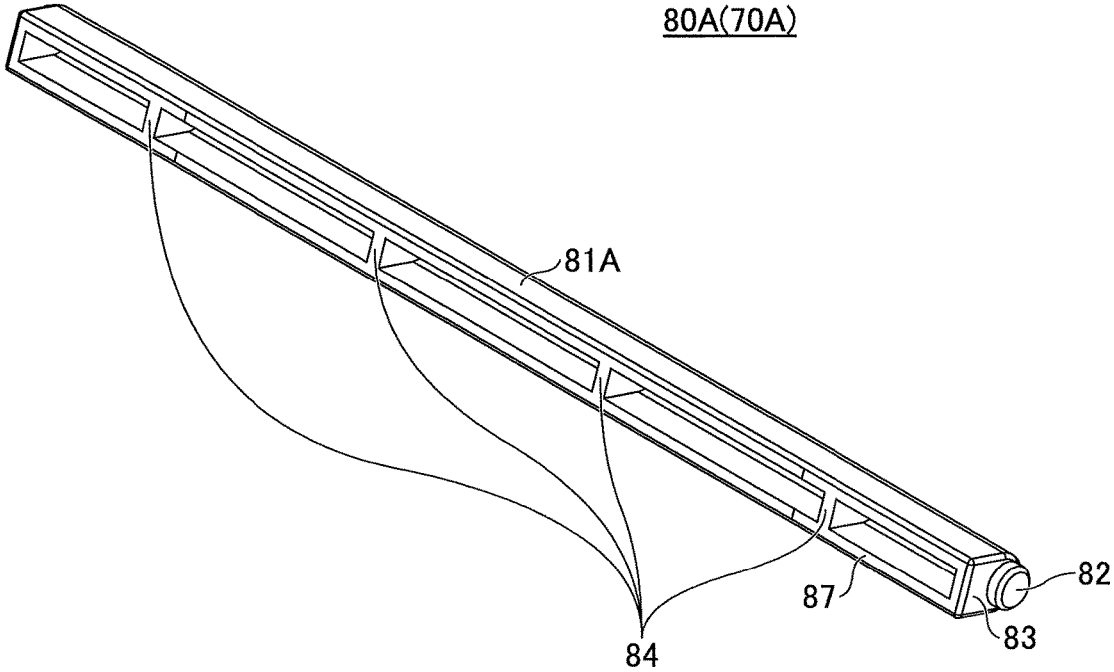
FIG. 7 is an enlarged perspective view of a stopper of a printer according to the first embodiment.

FIG. 1 is a perspective view of the printer 1A where a cover 20A is open. FIG. 2 is a perspective view of the printer 1A where the cover 20A is closed. FIG. 3 is a plan view of the cover 20A. FIG. 4 is a cross-sectional view of the printer 1A where the cover 20A is closed. FIG. 5 is a cross-sectional view of the printer 1A where the cover 20A is open. FIG. 6A is a drawing illustrating a state where the cover 20A is detached from a printer body 10. FIG. 6B is a partial enlarged view of a coupling mechanism. In the descriptions below, the direction of gravitational force is referred to as a "downward direction", and a direction opposite of the downward direction is referred to as an "upward direction".

The printer 1A is a drop-in-type printer, and includes a holder 11 that can hold recording paper 100 without using a paper-feed shaft.

The printer 1A includes the printer body 10, the cover 20A, a coupling mechanism 50, a contact part 60A, and a detachment preventing mechanism 70A.

The printer body 10 houses the recording paper 100, and a part of a printing mechanism is mounted on the printer body 10. The holder 11, a circuit board 12, motors 13 and 14, a thermal head 40, and a fixed blade 41 are disposed on the printer body 10.

The holder 11 and the printer body 10 are formed as a monolithic part. The holder 11 has a large opening so that the recording paper 100 can be placed in the holder 11.

The recording paper 100 is thermal paper and placed in the holder 11 in a rolled state. Hereafter, the rolled recording paper 100 is also referred to as a paper roll 100*a*.

Multiple ribs 16 are formed on the inner wall of the holder 11. The ribs 16 can reduce the contact area between the paper roll 100*a* placed in the holder 11 and the inner wall of the holder 11, and can reduce the friction between the paper roll 100*a* and the inner wall.

As illustrated in FIG. 4, the circuit board 12 is disposed on the upper back side of the printer body 10. The circuit board 12 includes a control circuit for controlling the printer 1A. One of the motors 13 and 14 is used to feed the recording paper 100, and the other one of the motors 13 and 14 is used to drive a movable blade 42.

As illustrated in FIG. 6A, shaft holes 17 (only one of the shaft holes 17 is illustrated in FIG. 6A) are formed in the right and left inner walls of the holder 11. The shaft holes 17 constitute a part of the coupling mechanism 50, and the cover 20A is rotatably attached to the shaft holes 17. In FIG. 6A, only a cover body 23 and the printer body 10 are illustrated, and other components such as the motors 13 and 14 and a platen roller 45 are omitted.

The thermal head 40 is disposed on the upper part of the printer body 10 and performs printing on the recording paper 100.

After information is printed, the recording paper 100 is cut by a cutter including the fixed blade 41 and the movable blade 42. The fixed blade 41 is disposed on the upper part of the printer body 10 at a position that is downstream of the location of the thermal head 40.

The cover 20A includes a lever 21, the cover body 23, the movable blade 42, and the platen roller 45.

The lever 21 is used to open the cover 20A, and is movable in a groove 22 formed in a surface of the cover body 23. When closed, the cover 20A is locked by a locking mechanism (not shown). Hereafter, the state where the cover 20A is closed is referred to as a "closed state".

The cover 20A can be opened by sliding the lever 21 downward and thereby unlocking the locking mechanism. Hereafter, the state where the cover 20A is open is referred to as an "open state".

The cover body 23 is a base of the cover 20A. The movable blade 42, the platen roller 45, the contact part 60A, and a stopper 80A are disposed on the cover body 23. The cover body 23 is formed by integral molding of a resin.

Side plates 24 are formed on the sides of the back surface, i.e., a surface facing the printer body 10, of the cover body 23. The side plates 24 and the cover body 23 are formed as a monolithic part. The side plates 24 are perpendicular to the back surface of the cover body 23. Shafts 28 constituting a part of the coupling mechanism 50 are formed on the outer sides of the corresponding side plates 24. The shafts 28 protrude outward from the outer sides of the side plates 24. Alternatively, the shafts 28 may be formed on the inner wall of the holder 11, and the shaft holes 17 may be formed in the side plates 24.

The movable blade 42 is disposed to face the fixed blade 41 on the printer body 10 when the cover 20A is closed. The recording paper 100 fed from the holder 11 is cut by the fixed blade 41 and the movable blade 42 that is moved by a motor toward the fixed blade 41.

The platen roller 45 is disposed on the upper part of the cover 20A. In a state where the cover 20A is closed, information is printed on the recording paper 100 that is fed from the holder 11 and sandwiched between the thermal head 40 and the platen roller 45.

In the state where the cover 20A is closed, a space for housing the recording paper 100 is formed between the inner wall of the cover 20A and the inner wall of the holder 11. Hereafter, the space formed between the cover 20A and the holder 11 is referred to as a housing chamber 15.

When the lever 21 is operated in the closed state, the cover 20A coupled by the coupling mechanism 50 to the printer body 10 rotates, and the printer 1A changes to the open state illustrated in FIGS. 1 and 5. In the open state, the housing chamber 15 is open and the paper roll 100*a* can be placed in the holder 11 as illustrated in FIG. 5. The paper roll 100*a* is housed in the housing chamber 15 by closing the cover 20A.

FIG. 4 illustrates a state where the paper roll 100*a* is housed in the housing chamber 15. In a printing process, the recording paper 100 is fed from the paper roll 100*a* in an upward direction in FIG. 4, information is printed on the recording paper 100 by the thermal head 40, and the recording paper 100 is ejected from an exit of the printer 1A in a direction B (indicated by an arrow B).

Because the printer 1A is a drop-in-type printer, the paper roll 100*a* in the housing chamber 15 moves in the lateral direction in FIG. 4. When the recording paper 100 is pulled out from the upper part of the printer 1A, the paper roll 100*a* rotates in a direction A (indicated by an arrow A) in the housing chamber 15, and moves in a direction C (indicated by an arrow C) toward the cover 20A.

Figure 26:
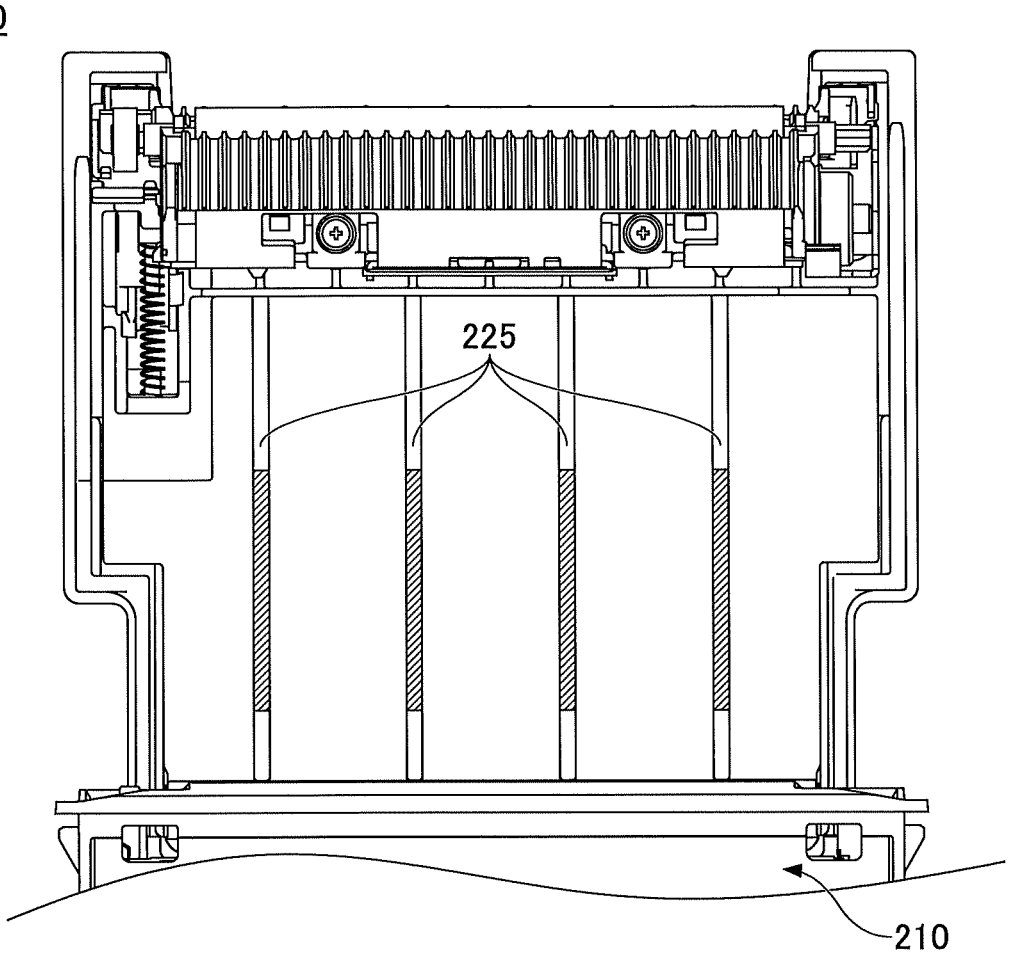
FIG. 26 is a plan view of a printer according to a comparative example.
Figure 27:
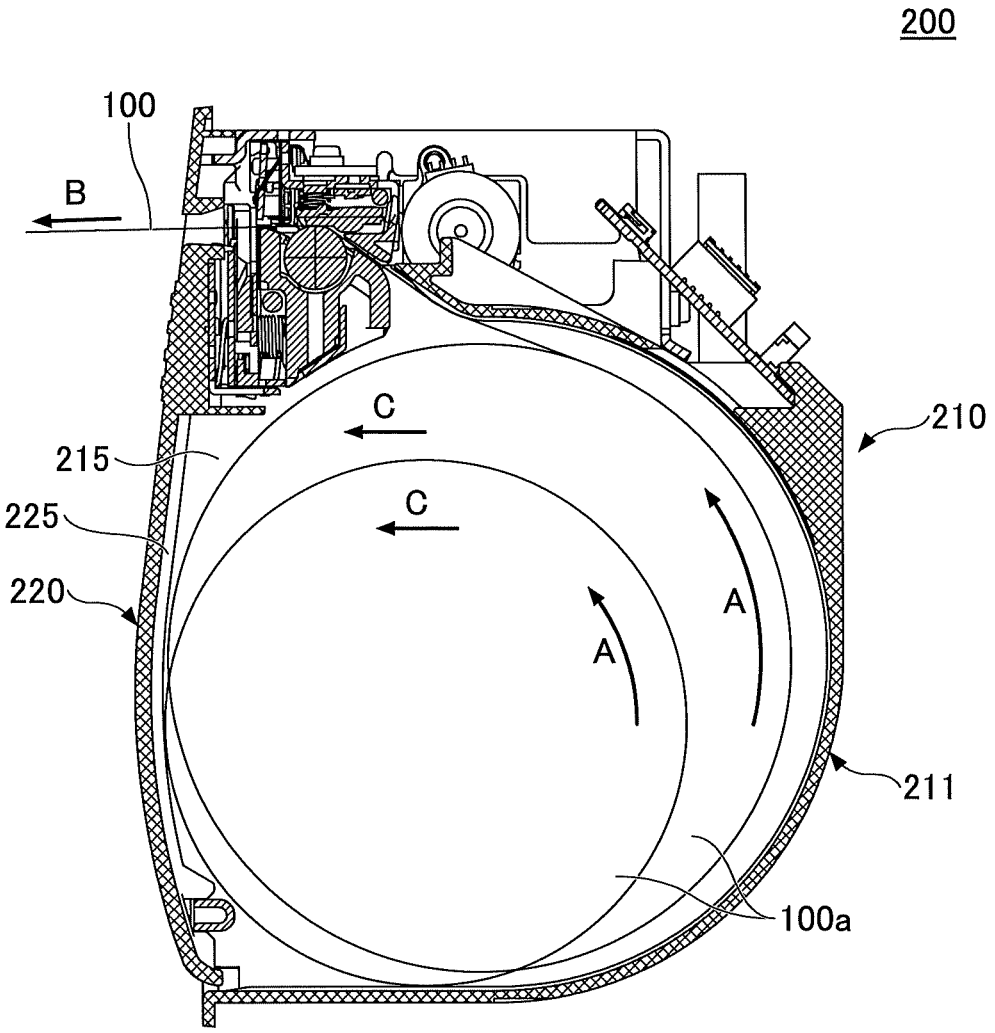
FIG. 27 is a cross-sectional view of a printer whose cover is closed according to the comparative example.

FIG. 26 is a plan view of a cover 220 of a comparative example. FIG. 27 is a cross-sectional view of a printer 200 of the comparative example where the cover 220 is closed.

The printer 200 is also a drop-in-type printer. Four ribs 225 extending in a vertical direction in FIG. 26 are formed on the inner wall of the cover 220.

When the recording paper 100 is pulled out at high speed, the paper roll 100*a* moves fast in the housing chamber 15. As a result, the surface of the paper roll 100*a* is caught on the ribs 225, the paper roll 100*a* and the ribs 225 collide with each other, and the paper roll 100*a* and the ribs 225 rub together to make a rubbing sound.

The surface of the paper roll 100*a* contacts the ribs 225 at low positions that are indicated by hatching in FIG. 26, and much of the rubbing sound is generated at these positions. The generation of the rubbing sound is not desirable in terms of the quietness of the printer 200.

Here, the ribs 225 extend in the vertical direction parallel to each other, and the paper roll 100*a* does not move in the lateral direction in the housing chamber 15 even when the diameter of the paper roll 100*a* decreases as the recording paper 100 is pulled out. Therefore, the ribs 225 are pressed against the same positions on the paper roll 100*a* in the width direction. As a result, indentations are formed on the paper roll 100*a* by the ribs 225.

To prevent this problem, the contact part 60A, which contacts the paper roll 110*a* in the housing chamber 15, is provided on the cover 20A of the printer 1A of the present embodiment.

As illustrated in FIGS. 3 and 4, the contact part 60A is disposed on the inner wall of the cover 20A. The contact part 60A is formed of an elastic metal wire with a circular cross section, and includes an angled portion 61A, attaching portions 62A, and supporting portions 63A.

The contact part 60A is not necessarily formed of a metal, and may be made of a resin. Also, the cross section of the contact part 60A is not limited to a circular shape, and may have any other shape as long as the contact part 60A can smoothly contact the paper roll 100*a*.

As illustrated in FIG. 3, the angled portion 61A has a substantially inverted-V shape. In the present embodiment, the contact part 60A includes one angled portion 61A. The angled portion 61A includes a peak portion 64A that protrudes upward and is located in the middle of the angled portion 61A in the width direction, and inclined portions 61A-1 and 61A-2 that extend diagonally to the left and right of the peak portion 64A in FIG. 3. The height of the peak portion 64A from the bottom of the housing chamber 15 is greater than the maximum radius of the paper roll 100*a* placed in the housing chamber 15.

The attaching portions 62A are detachably attached to protrusions 26 formed on the cover body 23. Each supporting portion 63A is located between the angled portion 61A and the corresponding attaching portion 62A, and supports the angled portion 61A together with the attaching portion 62A. The supporting portions 63A extend downward from the corresponding ends of the angled portion 61A. The supporting portions 63A are disposed in grooves formed in the side plates 24.

The contact part 60A is attached to the cover 20A by attaching the attaching portions 62A to the protrusions 26, and the contact part 60A is detached from the cover 20A by detaching the attaching portions 62A from the protrusions 26. Configuring the contact part 60A to be attachable and detachable to and from the cover 20A as described above makes it easier to maintain the contact part 60A.

The attaching portions 62A may instead be attached to parts of the cover 20A other than the protrusions 26. Also, the attaching portions 62A may be fixed to the cover 20A such that the contact part 60A is not detachable.

Next, operations of the contact part 60A are described.

As illustrated in FIGS. 4 (dotted line) and 5, when not in contact with the paper roll 100*a*, the angled portion 61A is inclined with respect to the inner wall of the cover 20A.

When the diameter of the paper roll 100*a* is large, the paper roll 100*a* in the housing chamber 15 contacts the contact part 60A. When the diameter of the paper roll 100*a* becomes small, the paper roll 100*a* moves in the direction C toward the cover 20A and contacts the contact part 60A.

When the paper roll 100*a* moves or the diameter of the paper roll 100*a* is large, the angled portion 61A is pressed by the paper roll 100*a* and is elastically deformed in a direction D (indicated by an arrow D) toward the cover 20A.

The paper roll 100*a* is biased to the right in FIG. 4 by the elasticity of the angled portion 61A that is elastically-deformed due to the movement of the paper roll 100*a*, and the moving force of the paper roll 100*a* toward the cover 20A is reduced by the biasing force. This configuration can prevent fast movement of the paper roll 100*a* toward the cover 20A, reduce the rubbing sound that is generated when the paper roll 100*a* contacts the angled portion 61A, and improve the quietness of the printer 1A.

How the paper roll 100*a* and the angled portion 61A contact each other is described below.

In the descriptions below, the side of the cover 20A where the platen roller 45 is provided is referred to as an upper side, and the side of the cover 20A where the shafts 28 are provided is referred to as a lower side.

The contact part 60A provided on the cover body 23 of the present embodiment has an inverted-V shape protruding upward and having an apex on the upper side. In the example of FIG. 3, one contact part 60A is provided on the cover body 23. The height of the peak portion 64A in the middle of the contact part 60A is greater than the maximum radius of the paper roll 100*a* placed in the housing chamber 15. Regardless of the diameter of the paper roll 100*a* in the housing chamber 15, the angled portion 61A contacts the paper roll 100*a* at two positions.

The contact part 60A is formed of a metal wire, and the angled portion 61A, which contacts the paper roll 100*a*, includes the inclined portions 61A-1 and 61A-2 that are inclined with respect to the axial direction of the paper roll 100*a*. Therefore, the angled portion 61A and the paper roll 100*a* substantially point-contact each other.

Here, "substantially point-contact" indicates not only a "point contact" in a strict sense but also a contact that is deemed to be a point contact. The "contact deemed to be a point contact" includes a point contact and a line contact with a contact area smaller than the contact area between the paper roll 100*a* and the ribs 225 in the comparative example.

The contact area between the angled portion 61A and the paper roll 100*a* changes depending on the pressing force at which the paper roll 100*a* is pressed against the contact part 60A. The "contact deemed to be a point contact" also includes a contact with a contact area within a variation range corresponding to the changes in the pressing force.

When the paper roll 100*a* is unrolled while in contact with the angled portion 61A, friction occurs between the rotating paper roll 100*a* and the angled portion 61A. In the present embodiment, the paper roll 100*a* and the angled portion 61A substantially point-contact each other, and the contact area between the paper roll 100*a* and the angled portion 61A is smaller than the contact area between the paper roll and the ribs in the comparative example. Therefore, the friction between the contact part 60A and the paper roll 100*a* is smaller than the friction in the comparative example, and the paper roll 100*a* rotates smoothly. Accordingly, the present embodiment can reduce the rubbing sound generated at the contact between the paper roll 100*a* and the angled portion 61A, and can provide the printer 1A with improved quietness.

As the recording paper 100 is pulled out and the diameter of the paper roll 100*a* decreases, the positions on the paper roll 100*a* contacting the angled portion 61A change in the width direction of the paper roll 100*a*.

Changes in the contact positions between the paper roll 100*a* and the angled portion 61A are described with reference to FIGS. 3 and 4.

In FIG. 4, a paper roll 100*a*-1 (which is hereafter referred to as a large paper roll) indicates the paper roll 100*a* whose diameter is at the maximum. A paper roll 100*a*-2 (which is hereafter referred to as a medium paper roll) indicates the paper roll 100*a* whose diameter is reduced to about two thirds of the maximum diameter. A paper roll 100*a*-3 (which is hereafter referred to as a small paper roll) indicates the paper roll 100*a* whose diameter is reduced to about one third of the maximum diameter.

Because the diameter is large, the large paper roll 100*a*-1 contacts the angled portion 61A at two upper contact positions P1 in FIG. 3 that are close to the peak portion 64A. The two contact positions P1 contacting the large paper roll 100*a*-1 are close to each other.

When the recording paper 100 is pulled out and the diameter of the paper roll 100*a* decreases, the paper roll 100*a* becomes the medium paper roll 100*a*-2. The medium paper roll 100*a*-2 contacts the angled portion 61A at contact positions P2 that are located lower than and outer than the contact positions P1 in FIG. 3.

When the diameter of the paper roll 100*a* further decreases, the paper roll 100*a* becomes the small paper roll 100*a*-3. The small paper roll 100*a*-3 contacts the angled portion 61A at contact positions P3 that are located lower than and outer than the contact positions P2 in FIG. 3.

As described above, because the angled portion 61A has an inverted-V shape and the diameter of the paper roll 100*a* gradually decreases, positions on the paper roll 100*a* contacting the angled portion 61A change as the recording paper 100 is pulled out and gradually move in the outward direction. Thus, because the positions on the paper roll 100*a* contacting the angled portion 61A change as the diameter of the paper roll 100*a* decreases, even when the paper roll 100*a* is pressed against the angled portion 61A, formation of indentations on the recording paper 100 is prevented.

Next, the detachment preventing mechanism 70A is described with reference to FIGS. 6A through 14.

With the shafts 28 fitted into the shaft holes 17, the cover 20A is rotatably attached to the printer body 10. However, when an external force is applied to the cover 20A, the side plates 24 are displaced inward and the shafts 28 may come out of the shaft holes 17.

In the case of a desktop printer, the chance that a paper roll is placed on a cover is low. In contrast, in the case of a panel mount printer such as the printer 1A whose cover 20A is opened toward the user, the chance that the paper roll 100*a* is placed on or dropped onto the cover 20A while setting the paper roll 100*a* increases. Thus, there is a higher risk that an external force is applied to the cover 20A, and the rotational shafts of the thinned cover 20A are broken.

The detachment preventing mechanism 70A of the present embodiment prevents the cover 20A from being detached from the printer body 10 when an external force is applied to the cover 20A.

The detachment preventing mechanism 70A includes recesses 29, grooves 27, and the stopper 80A.

The recesses 29 are closed-end holes formed in the inner walls of the side plates 24 of the cover body 23. A protruding surface 29*a* protruding inward from the side plate 24 is formed around each recess 29 (see FIG. 6B).

In the present embodiment, the recesses 29 are disposed at positions that are shifted from the positions where the shafts 28 are formed. However, to prevent the shafts 28 from coming out of the shaft holes 17, the shafts 28 and the recesses 29 are preferably positioned close to each other and may be disposed on the same axis.

The grooves 27 to which the stopper 80A is attached are formed in ribs 25 that are formed on the inner wall of the cover body 23. A pair of protrusions 26 are formed on the sides of each groove 27. In other words, the groove 27 is formed between each pair of the protrusions 26. The height of the bottom surface of the groove 27 is substantially the same as the height of the inner wall of the cover body 23. The grooves 27 are disposed on a line connecting the right and left recesses 29.

The grooves 27 are not necessarily formed in the ribs 25, and may be formed in other positions on the inner surface of the cover body 23.

The stopper 80A includes a stopper body 81A, protrusions 82, and stopper surfaces 83. The stopper body 81A is shaped like a rod with a semi-cylindrical cross section. Multiple reinforcing ribs 84 are formed in a space inside of the stopper body 81A. The strength of the stopper 80A can be adjusted by changing the number and the positions of the reinforcing ribs 84.

The stopper body 81A may also have a cross-sectional shape other than the semi-cylindrical shape such as a circular shape, a rectangular shape, or an elliptical shape. Also, the reinforcing ribs 84 may be omitted, and may be provided only when it is necessary to adjust the strength of the stopper 80A.

The protrusions 82 and the stopper surfaces 83 are formed at the ends of the stopper body 81A. Each protrusion 82 has a cylindrical shape and engages with the corresponding recess 29. Each stopper surface 83 is formed at a position that is shifted from the protrusion 82 toward a bottom surface 87. Alternatively, the protrusions 82 may be formed in the inner walls of the side plates 24, and the recesses 29 may be formed at the ends of the stopper body 81A.

Next, a method of attaching the stopper 80A to the cover 20A is described.

FIG. 6A illustrates a state where the cover 20A is detached from the printer body 10. The cover 20A is attached to the printer body 10 before the stopper 80A is attached to the cover 20A. The cover 20A is attached to the printer body 10 by fitting the shafts 28 formed on the side plates 24 into the shaft holes 17 formed in the holder 11. The shafts 28 are fitted into the shaft holes 17 as indicated by a dashed-dotted line that is indicated by an arrow G in FIG. 6A.

Figure 8:
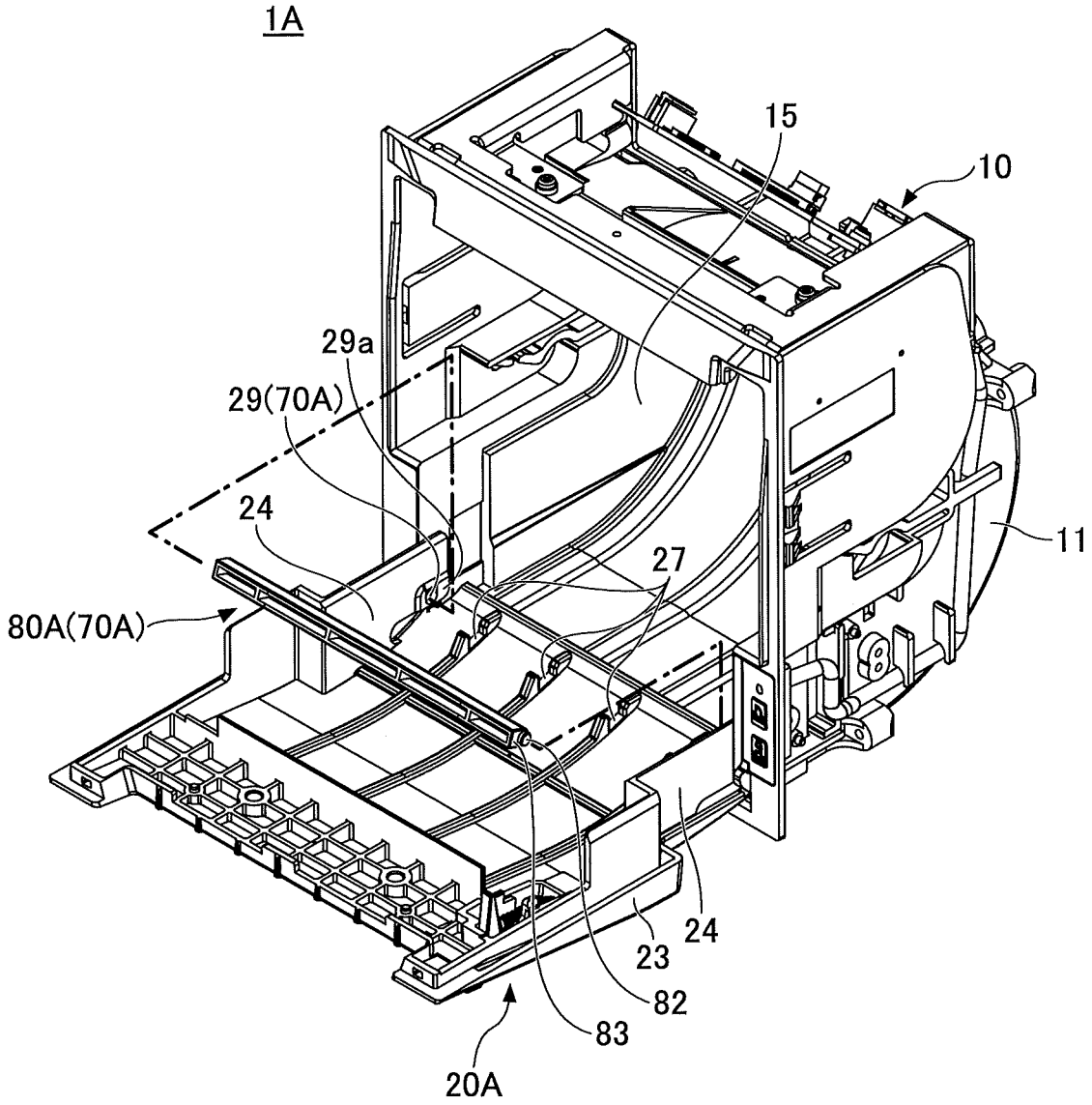
FIG. 8 is a drawing illustrating a method of attaching a stopper according to the first embodiment.

FIG. 8 illustrates a state where the cover 20A is attached to the printer body 10. The stopper 80A is attached to the cover 20A that is attached to the printer body 10. Specifically, as indicated by a dashed-dotted line in FIG. 8, the protrusions of the stopper 80A are inserted into the recesses 29 formed in the side plates 24.

Figure 9:
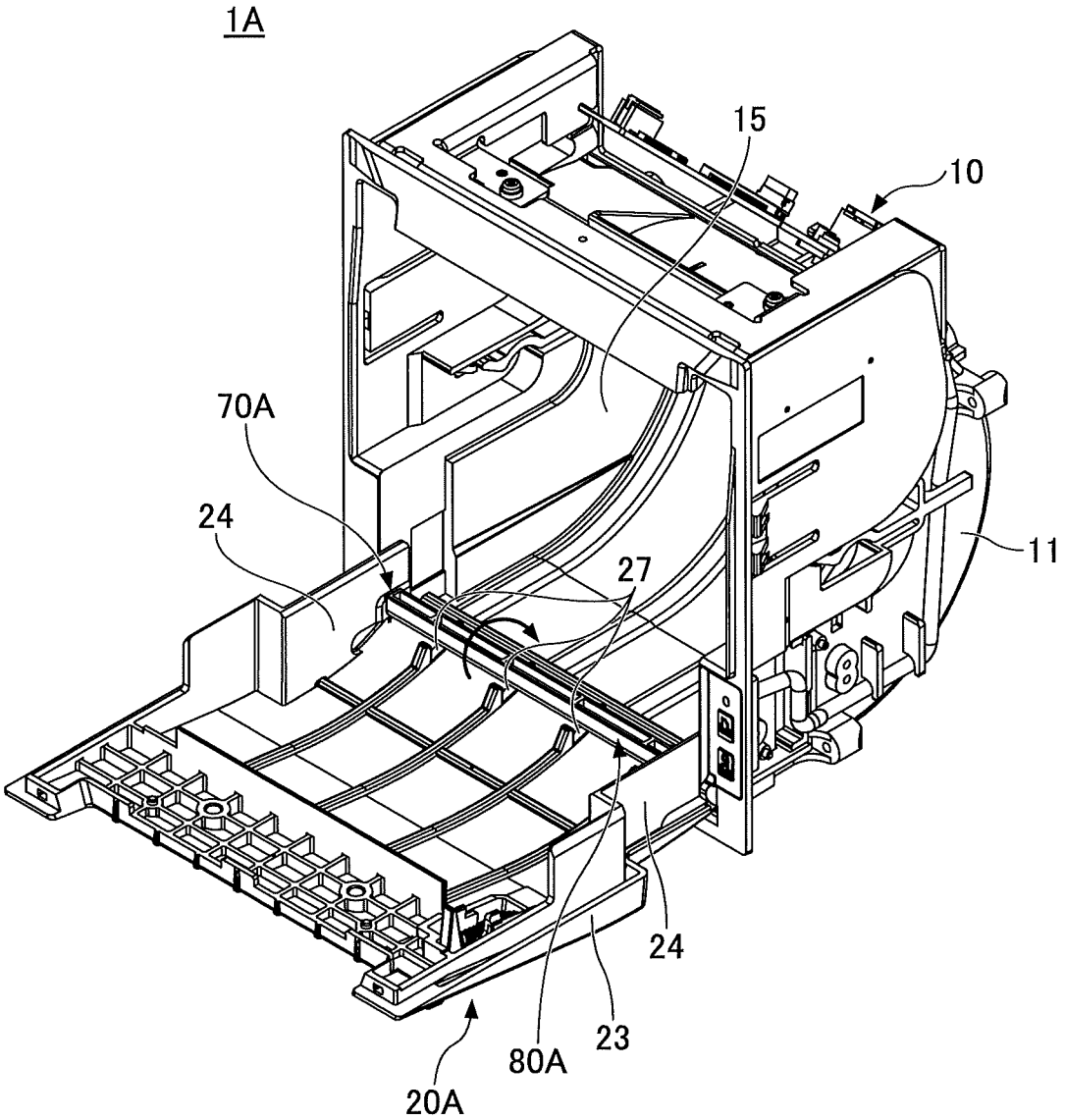
FIG. 9 is a drawing illustrating a method of attaching a stopper according to the first embodiment.

FIG. 9 illustrates a state where the protrusions 82 of the stopper 80A are inserted in the recesses 29 formed in the side plates 24. When the protrusions 82 are inserted in the recesses 29, the stopper 80A is positioned in the grooves 27. In this state, the stopper surfaces 83, which are offset from the protrusions 82, face the protruding surfaces 29*a* formed around the respective recesses 29.

When the stopper 80A is attached to the cover 20A in a correct orientation, the curved surface of the stopper 80A faces upward. In FIG. 9, the stopper 80A is attached to the cover 20A with the bottom surface 87 (see FIG. 7) facing upward. That is, the stopper 80A is attached to the cover 20A in an incorrect orientation.

In this case, as indicated by an arrow in FIG. 9, the stopper 80A is rotated so that the bottom surface 87 of the stopper 80A faces the inner wall of the cover 20A.

Figure 10:
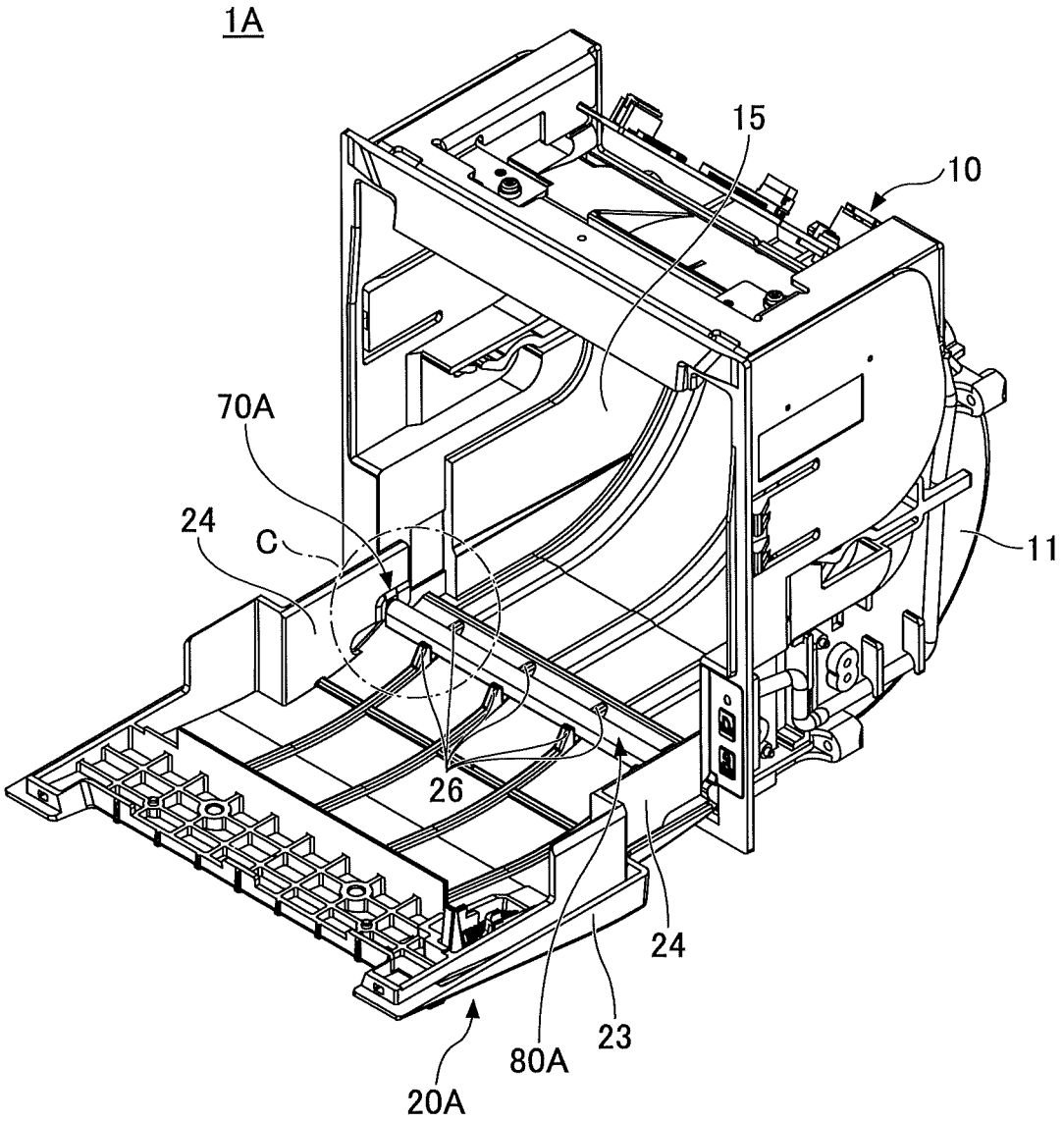
FIG. 10 is a drawing illustrating a method of attaching a stopper according to the first embodiment.

FIG. 10 illustrates a state where the stopper 80A is properly attached to the cover 20A. When the stopper 80A is properly attached to the cover 20A, the curved surface of the stopper 80A faces upward, and the design of the printer is improved. This also makes it possible to prevent the stopper 80A from damaging the paper roll 100*a* placed in the housing chamber 15.

Also, when the stopper 80A is properly attached to the cover 20A, the stopper body 81A engages with the protrusions 26, and the bottom surface 87 contacts the inner wall of the cover body 23. Thus, the stopper 80A is positioned by the grooves 27 and the inner wall of the cover body 23. In this state, even when a downward force is applied to the cover 20A and the side plates 24 start to fall inward, the stopper surfaces 83 of the stopper 80A contact the side plates 24 and prevent the side plates 24 from falling inward. Thus, this configuration can prevent detachment of the cover 20A from the printer body 10.

Figure 11:
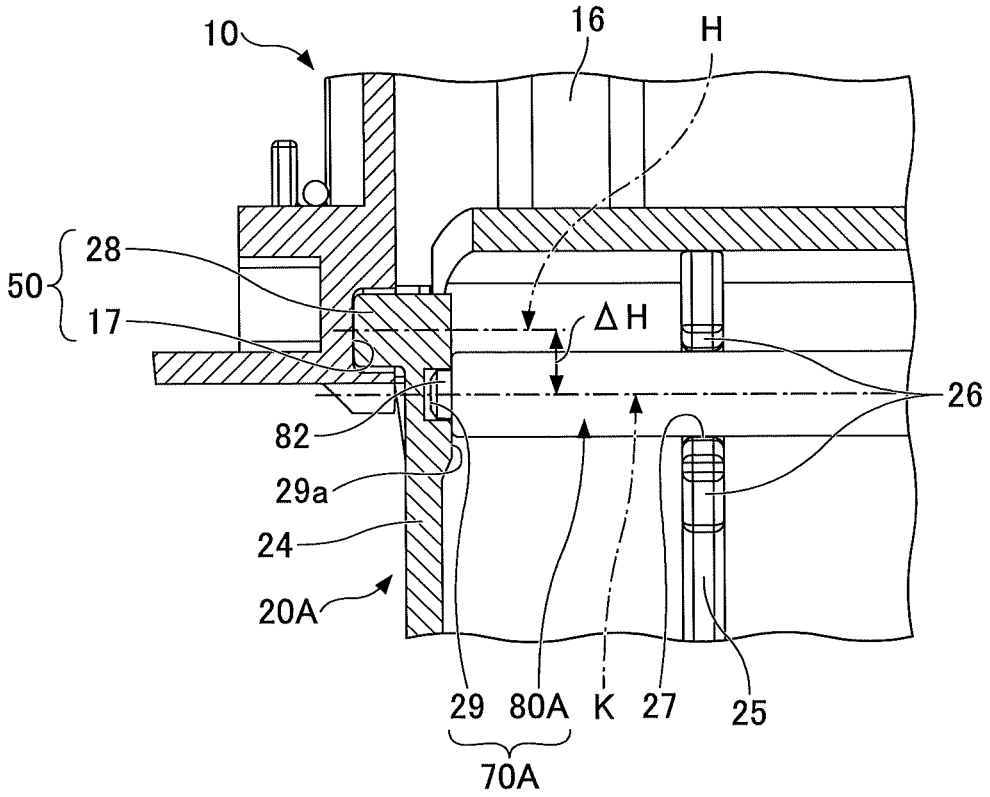
FIG. 11 is an enlarged cross-sectional view of a coupling mechanism and a detachment preventing mechanism according to the first embodiment.

FIG. 11 illustrates the coupling mechanism 50 and the detachment preventing mechanism 70A in a state where the stopper 80A is attached to the cover 20A. FIG. 11 is an enlarged cross-sectional view of a part surrounded by a dashed-dotted line C in FIG. 10.

In a state where the cover 20A is attached to the printer body 10 and the stopper 80A is attached to the cover 20A, the shafts 28 are fitted in the shaft holes 17 and the protrusions 82 of the stopper 80A are fitted in the recesses 29. Although not illustrated in FIG. 11, the stopper surfaces 83 face the protruding surfaces 29*a*. In the present embodiment, the central axis (a dashed-dotted line indicated by an arrow H in FIG. 11) of the coupling mechanism 50 and the central axis (a dashed-dotted line indicated by an arrow K in FIG. 11) of the detachment preventing mechanism 70A are shifted from each other by a distance ΔH.

Next, the workings of the detachment preventing mechanism 70A when an external force is applied to the cover 20A in the open state are described.

Figure 12:
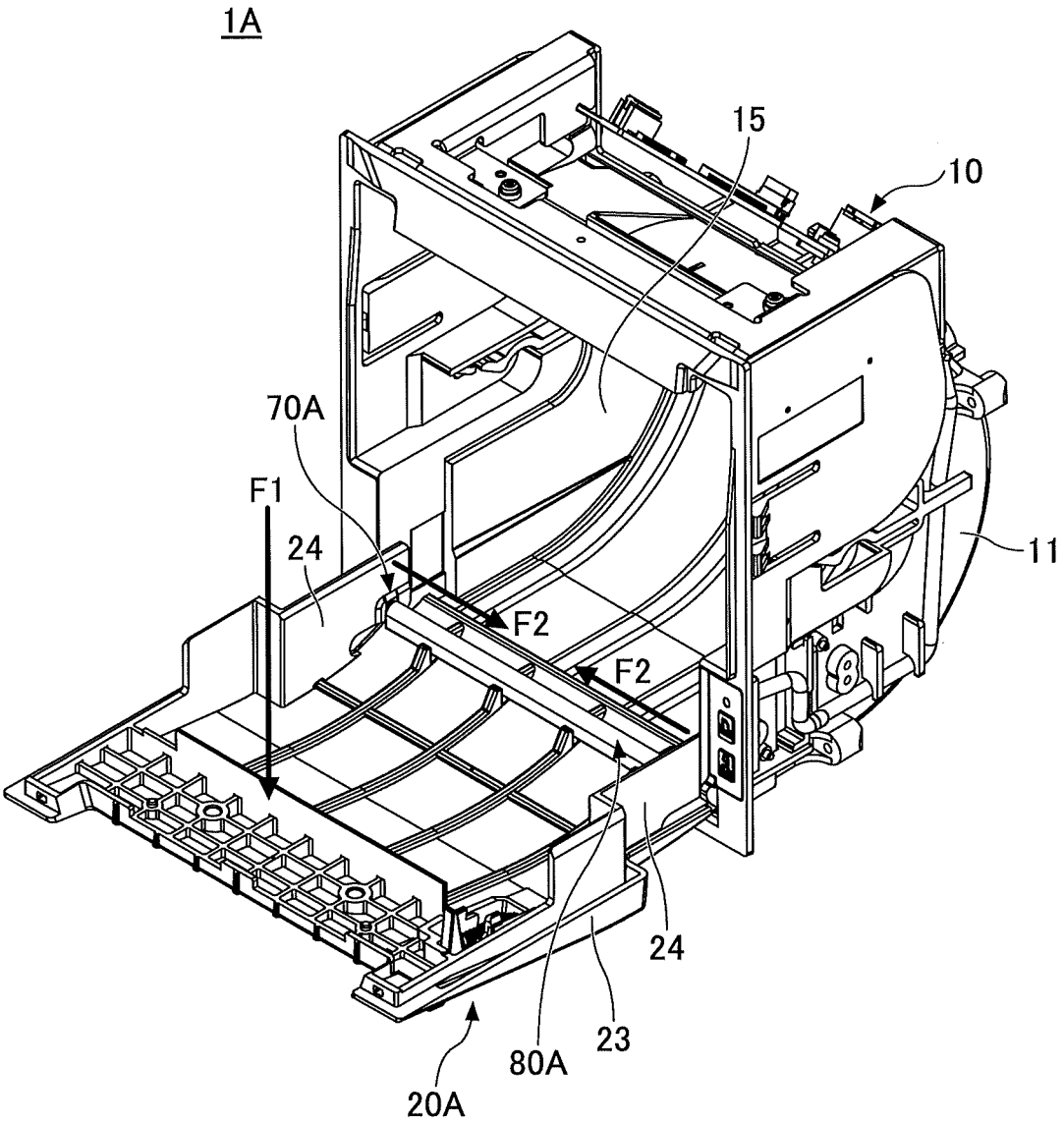
FIG. 12 is a drawing illustrating the workings of a detachment preventing mechanism according to the first embodiment.

FIG. 12 illustrates a state where an external force F1 is applied downward to the cover 20A in the open state. The external force F1 is applied to the cover 20A when, for example, the paper roll 100*a* is mistakenly dropped onto the cover 20A or the cover 20A is mistakenly pressed by an operator during a process to replace the paper roll 100*a*.

When the external force F1 is applied and the cover 20A is pressed downward, the side plates 24 of the cover 20A fall inward relative to the holder 11. That is, when the cover 20A is pressed downward, a force (indicated by an arrow F2 in FIG. 12) that causes the shaft 28 to come out of the shaft hole 17 is applied between the inner wall of the holder 11 and each of the side plates 24. When the force F2 is applied, because the side plates 24 are thinner and have lower strength than the inner wall of the holder 11, the side plates 24 are displaced inward.

However, because the stopper 80A is provided between the facing side plates 24, the side plates 24 caused to move inward by the force F2 contact the stopper surfaces 83 at the ends of the stopper 80A, and the inward movement of the side plates 24 is limited. Also, because the recesses 29 are biased toward the protrusions 82 by the inward movement of the side plates 24, the protrusions 82 do not come out of the recesses 29 even when the force F2 is applied to the side plates 24.

Thus, the detachment preventing mechanism 70A can limit the movement of the side plates 24 and prevent the shafts 28 from coming out of the shaft holes 17. This in turn makes it possible to prevent the cover 20A from being detached from the printer body 10 even when an external force is applied to the cover 20A, and improve the reliability of the printer 1A.

Here, there may be a case where a very large external force that the stopper 80A cannot sustain is applied to the cover 20A. With the configuration where the stopper 80A still supports the side plates 24 even when such a large external force is applied to the cover 20A, the side plates 24 may be damaged, the stopper 80A may be broken, and/or the protrusions 82 may be crushed. Thus, providing the stopper 80A may result in damaging the cover 20A.

Accordingly, to prevent damage to the printer 1A, it is preferable to release the stopper 80A supporting the side plates 24 and allow the cover 20A to be detached from the printer body 10 when a large external force is applied to the cover 20A. For this reason, in the present embodiment, the detachment preventing mechanism 70A is configured such that the stopper 80A is detached from the cover 20A when a large external force is applied to the cover 20A.

The workings of the detachment preventing mechanism 70A when a large external force is applied to the cover 20A are described with reference to FIGS. 13 and 14.

Figure 13:
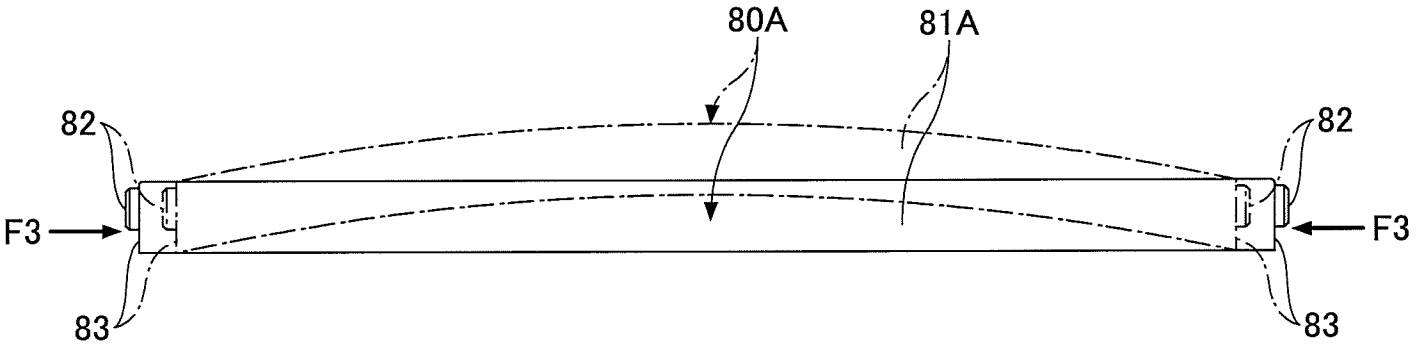
FIG. 13 is a drawing illustrating the workings of a detachment preventing mechanism according to the first embodiment.
Figure 14:
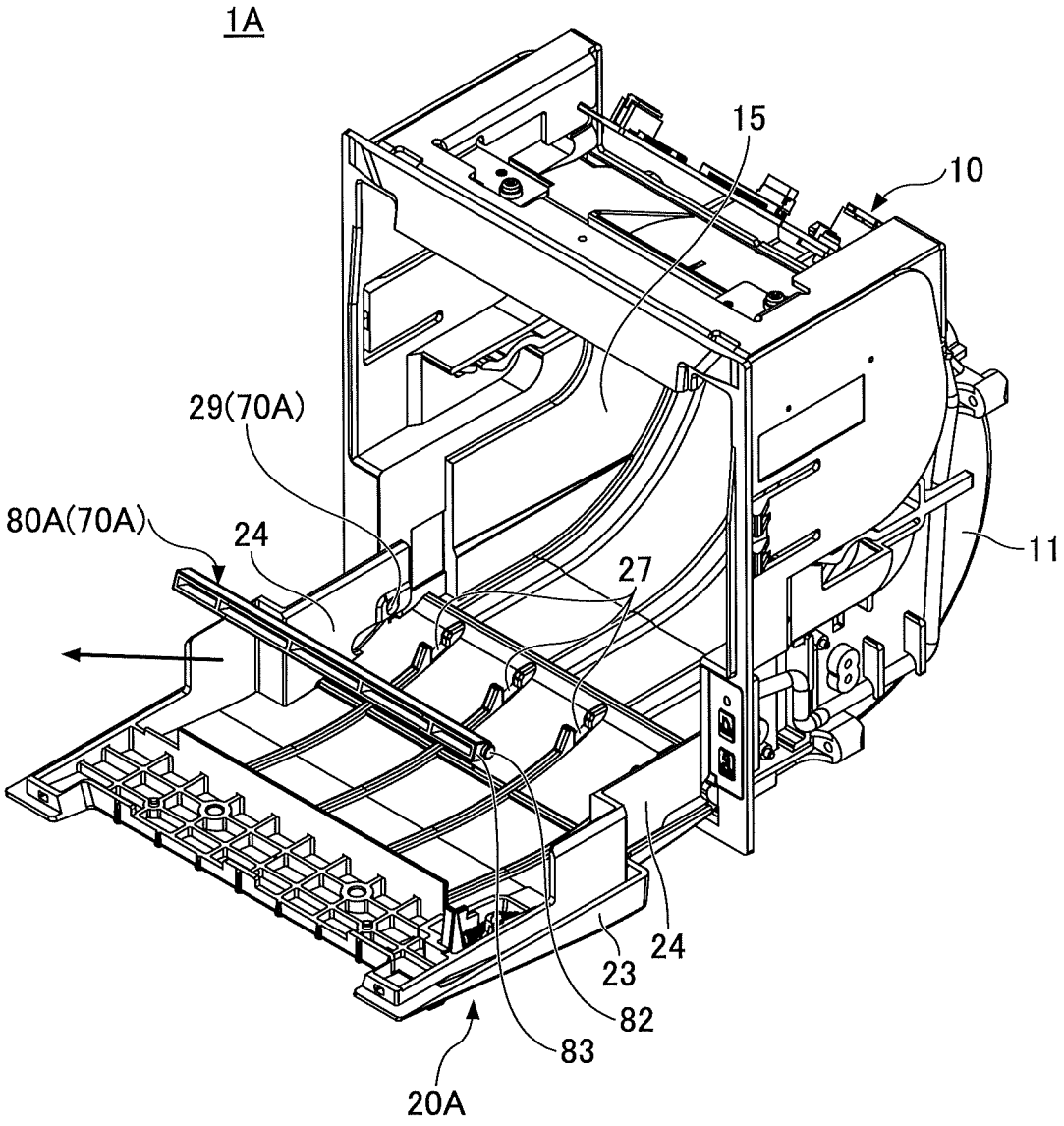
FIG. 14 is a drawing illustrating the workings of a detachment preventing mechanism according to the first embodiment.

FIG. 13 illustrates a state where an external force is applied to the cover 20A and a force (which is hereafter referred to as an external force F3) indicated by an arrow F3 is applied to the ends of the stopper 80A.

When the external force is applied to the cover 20A and the side plates 24 fall inward, the side plates 24 contact the stopper surfaces 83 of the stopper 80A, and the external force F3 is applied to the stopper surfaces 83.

Because the stopper surfaces 83 are offset from the center of the stopper 80A, the external force F3 applied to the stopper surfaces 83 generates a moment on the stopper 80A, and the stopper 80A is deformed into an arcuate shape as indicated by a dashed-dotted line in FIG. 13.

When the stopper 80A is deformed into an arcuate shape, the protrusions 82 move apart from the recesses 29, and the stopper 80A is disengaged from the cover 20A. As a result, the stopper 80A becomes detachable from the cover 20A. FIG. 14 illustrates a state where the stopper 80A is detached from the cover 20A.

When the protrusions 82 are disengaged from the recesses 29, the stopper 80A deformed into the arcuate shape tends to recover its original shape due to elasticity. The stopper 80A whose protrusions 82 are disengaged from the recesses 29 jumps out of the cover 20A due to this recovering force. With the above configuration of the detachment preventing mechanism 70A, the stopper 80A is automatically detached from the cover 20A when a large external force is applied. For example, this configuration can prevent the side plates 24 from being damaged, prevent the stopper 80A from being broken, and prevent the protrusions 82 from being crushed.

The amount by which the stopper 80A deforms when the external force F3 is applied can be adjusted by, for example, changing the number of the reinforcing ribs 84 provided in the stopper body 81A.

Next, printers 1B through 1E according to other embodiments are described.

FIGS. 15 through 22 are drawings illustrating the printers 1B through 1E according to other embodiments. The same reference numbers as those assigned to the components of the printer 1A of the first embodiment are assigned to the corresponding components in FIGS. 15 through 22, and repeated descriptions of those components may be omitted.

Figure 15:
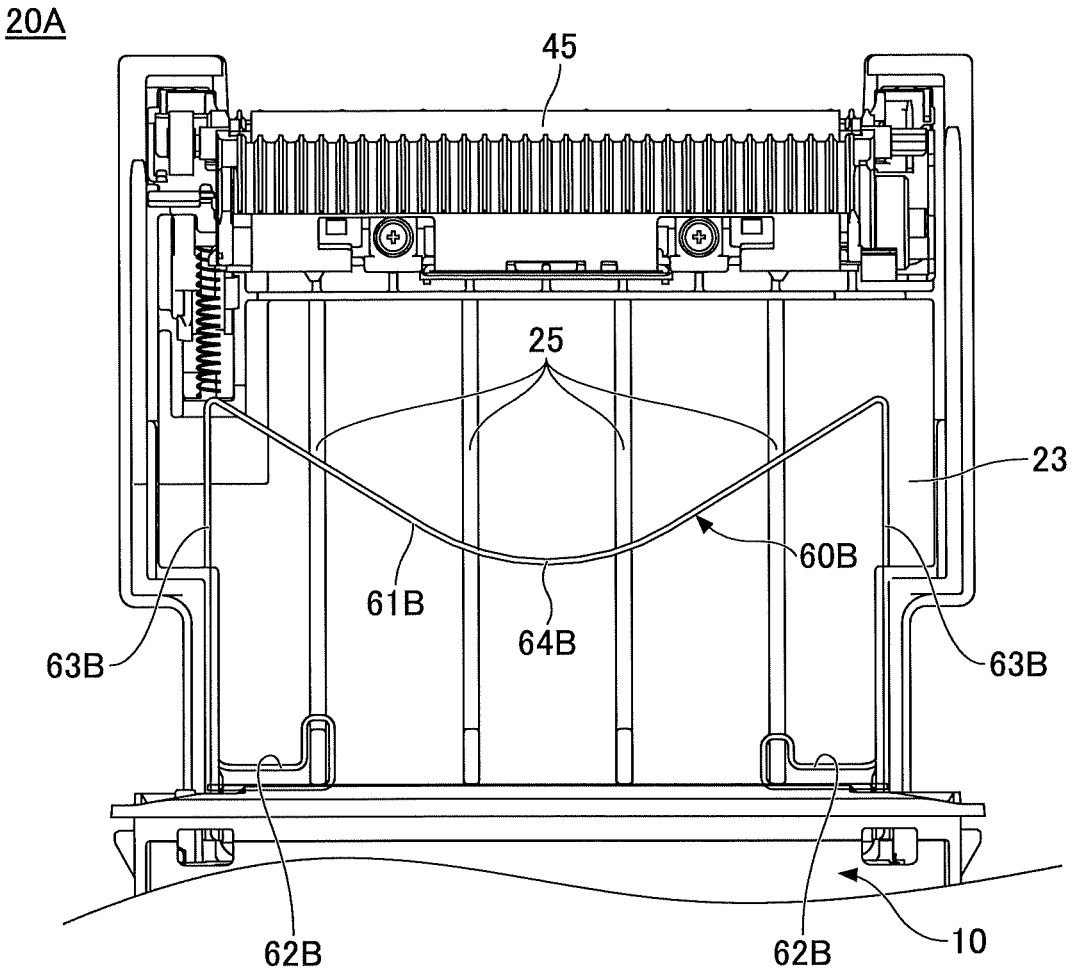
FIG. 15 is a plan view of a printer according to a second embodiment.
Figure 16:
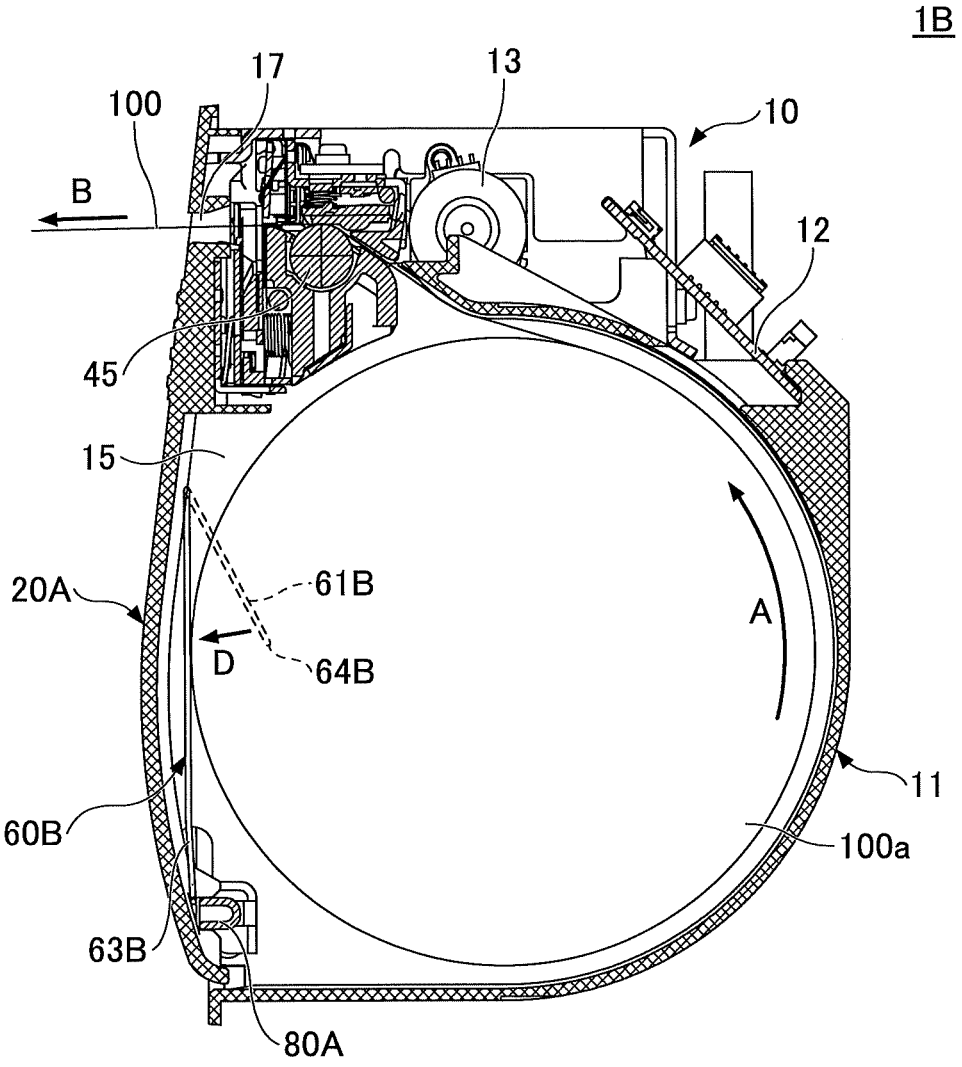
FIG. 16 is a cross-sectional view of a printer whose cover is closed according to the second embodiment.

FIGS. 15 and 16 illustrate the printer 1B according to a second embodiment. FIG. 15 is a plan view of the cover 20A, and FIG. 16 is a cross-sectional view of the printer 1B with the cover 20A closed.

A contact part 60B of the printer 1B includes one angled portion 61B including a peak portion 64B that protrudes downward. The ends of the angled portion 61B are connected to the upper ends of supporting portions 63B that extend upward from attaching portions 62B.

As indicated by a dotted line in FIG. 16, when not in contact with the paper roll 100*a*, the angled portion 61B is inclined forward with respect to the inner wall of the cover 20A. When the paper roll 100*a* contacts the angled portion 61B, the angled portion 61B is elastically deformed in a direction D (indicated by an arrow D) toward the cover 20A.

The moving force of the paper roll 100*a* toward the cover 20A is reduced by the elastic force generated by elastic deformation of the angled portion 61B. This configuration can prevent fast movement of the paper roll 100*a* toward the cover 20A, and reduce the rubbing sound that is generated when the paper roll 100*a* contacts the angled portion 61B.

Also in the second embodiment, the contact part 60B is formed of a wire, and substantially point-contacts the paper roll 100*a*. Accordingly, the friction between the contact part 60B and the paper roll 100*a* is reduced, and the generation of rubbing sound is reduced.

Figure 17:
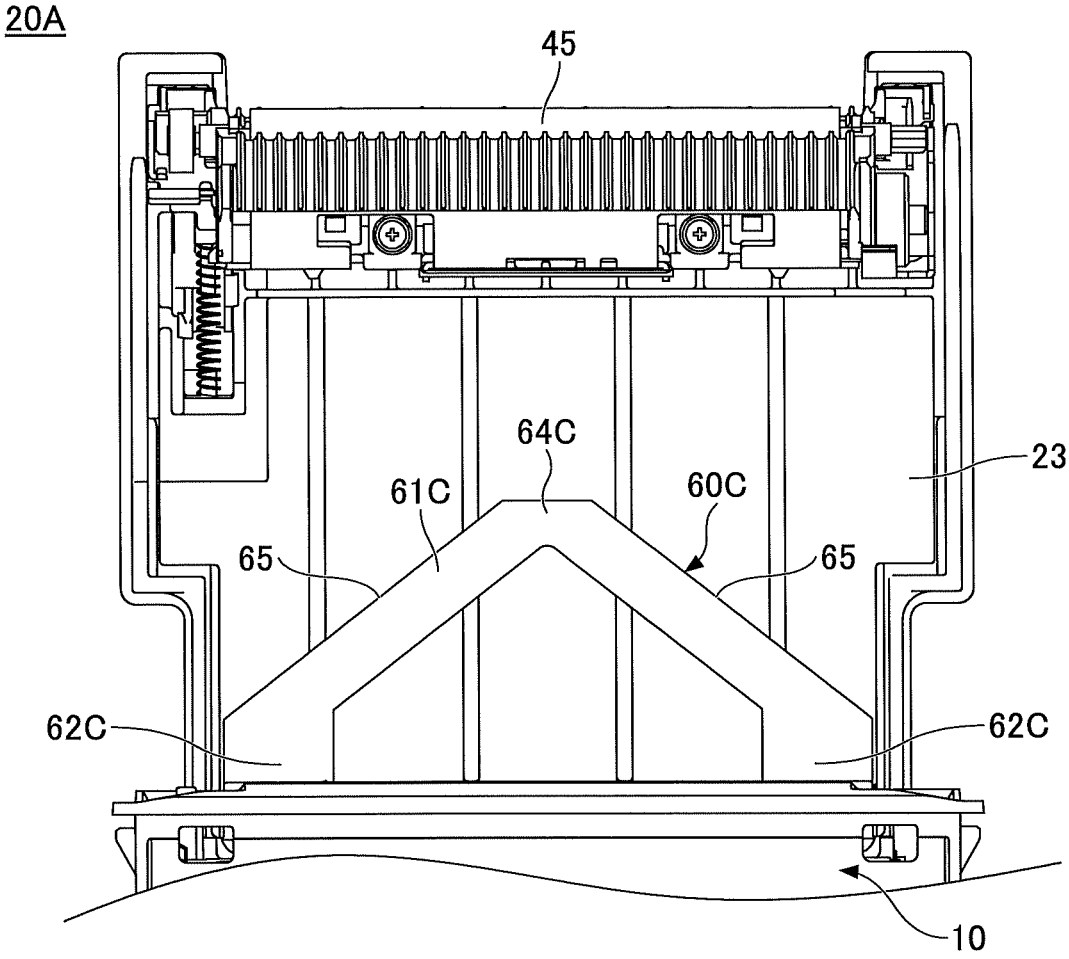
FIG. 17 is a plan view of a printer according to a third embodiment.
Figure 18:
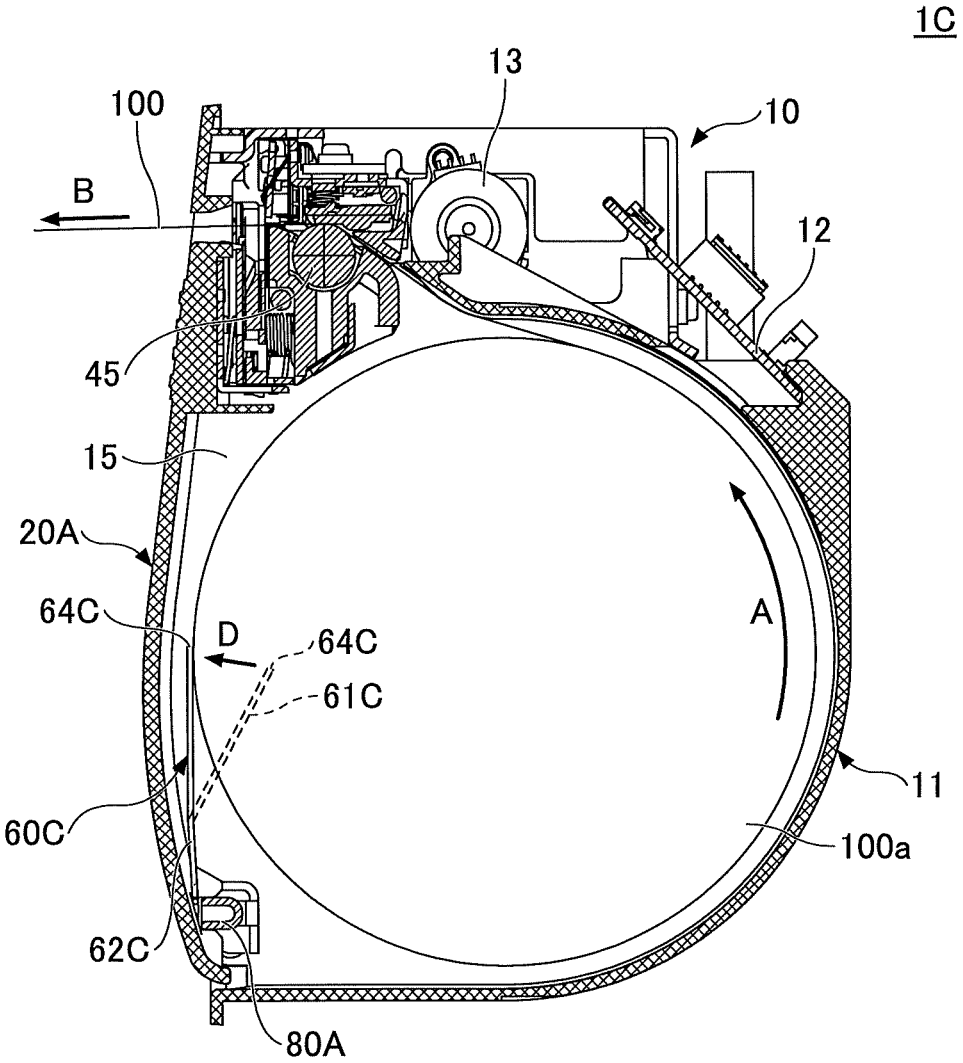
FIG. 18 is a cross-sectional view of a printer whose cover is closed according to the third embodiment.

FIGS. 17 and 18 illustrate the printer 1C according to a third embodiment. FIG. 17 is a plan view of the cover 20A, and FIG. 18 is a cross-sectional view of the printer 1C with the cover 20A closed.

The printer 1C illustrated by FIGS. 17 and 18 includes a contact part 60C that is formed by pressing a metal plate into an inverted-V shape.

The contact part 60C includes an angled portion 61C. The ends of the angled portion 61C are attached via attaching portions 62C to the cover 20A. The height of the upper side of a peak portion 64C is greater than the maximum radius of the paper roll 100*a* placed in the housing chamber 15.

Also in the third embodiment, when the paper roll 100*a* contacts the angled portion 61C, the angled portion 61C is elastically deformed and the moving force of the paper roll 100*a* is reduced. This configuration can reduce the generation of rubbing sound and improve the quietness of the printer 1C.

In the third embodiment, upper outer edges of the angled portion 61C close to the platen roller 45 contact the paper roll 100*a*. The edges 65 extend obliquely downward and outward from the peak portion 64C.

Because the edges 65 contact the paper roll 100*a*, the angled portion 61C and the paper roll 100*a* substantially point-contact each other. Accordingly, the friction between the contact part 60C and the paper roll 100*a* is reduced, and the generation of rubbing sound is reduced.

Also, because the angled portion 61C has an inverted-V shape, the positions on the paper roll 100*a* contacting the edges 65 change as the diameter of the paper roll 100*a* decreases. Thus, the printer 1C can also prevent formation of indentations on the recording paper 100.

Figure 19:
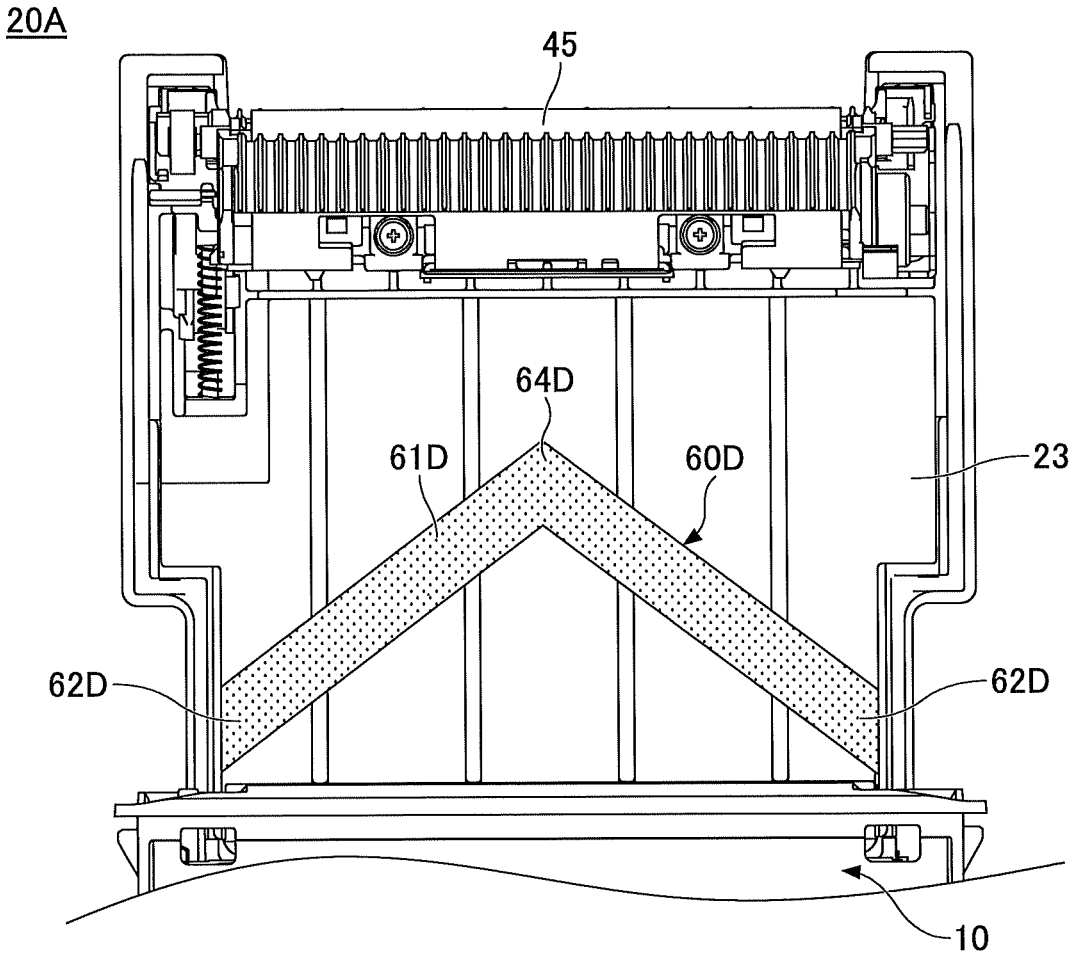
FIG. 19 is a plan view of a printer according to a fourth embodiment.
Figure 20:
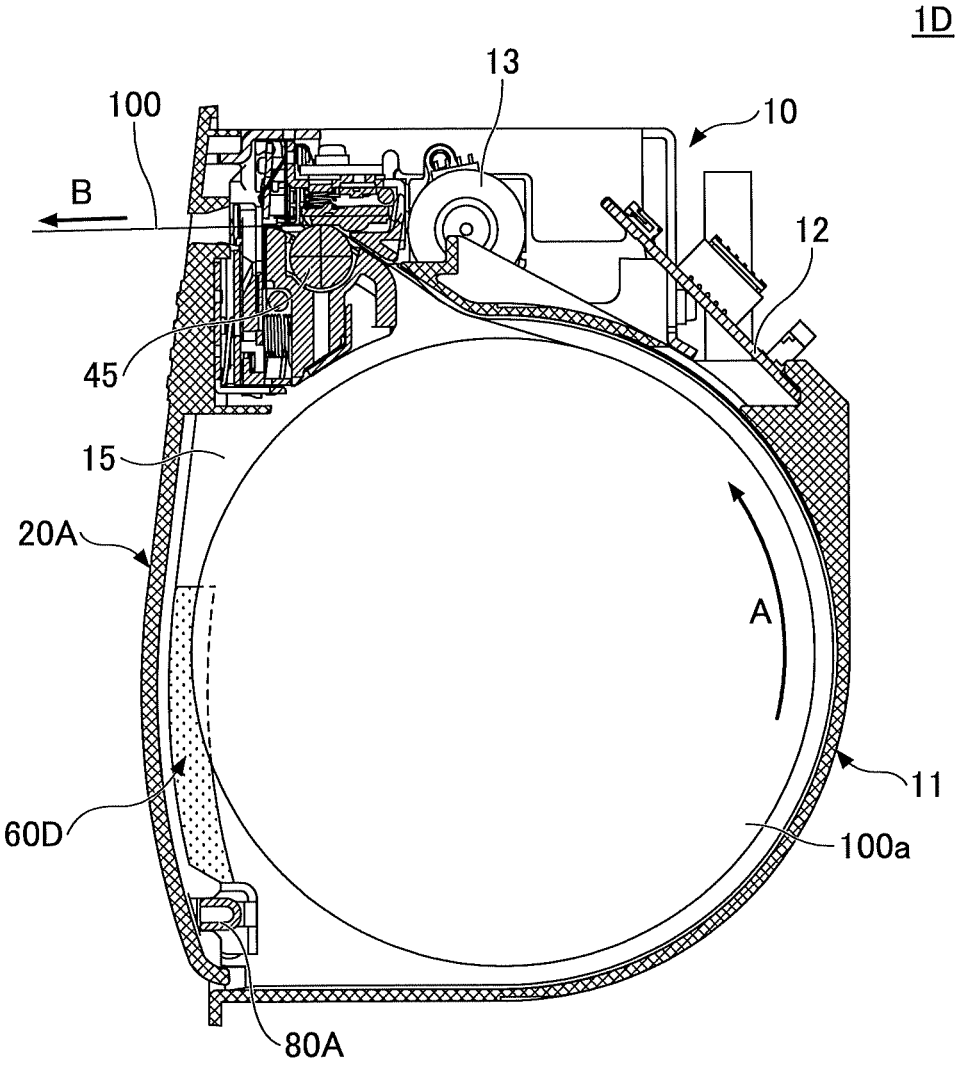
FIG. 20 is a cross-sectional view of a printer whose cover is closed according to the fourth embodiment.

FIGS. 19 and 20 illustrate the printer 1D according to a fourth embodiment. FIG. 19 is a plan view of the cover 20A, and FIG. 20 is a cross-sectional view of the printer 1D with the cover 20A closed.

The printer 1D illustrated by FIGS. 19 and 20 includes a contact part 60D that is formed of a sponge that functions as a sound-absorbing material. However, the material of the contact part 60D is not limited to a sponge, and the contact part 60D may be formed of any material that can maintain a predetermined shape and has a sound-absorbing function.

The contact part 60D includes an angled portion 61D. The ends of the angled portion 61D are attached to the cover 20A. The height of a peak portion 64D is greater than the maximum radius of the paper roll 100*a* placed in the housing chamber 15.

When the paper roll 100*a* moves toward the cover 20A as the paper roll 100*a* is unrolled, the angled portion 61D is pressed and deformed by the paper roll 100*a*. The deformed angled portion 61D biases the paper roll 100*a* to the right in FIG. 20. As a result, the moving force of the paper roll 100*a* is reduced, and the rubbing sound is reduced. Also, because the contact part 60D is formed of a sponge that functions as a sound-absorbing material, the rubbing sound is absorbed by the contact part 60D.

The hardness of the contact port 60D and the force at which the contact part 60D presses the paper roll 100*a* are set at appropriate values so that indentations are not formed on the recording paper 100.

Figure 21:
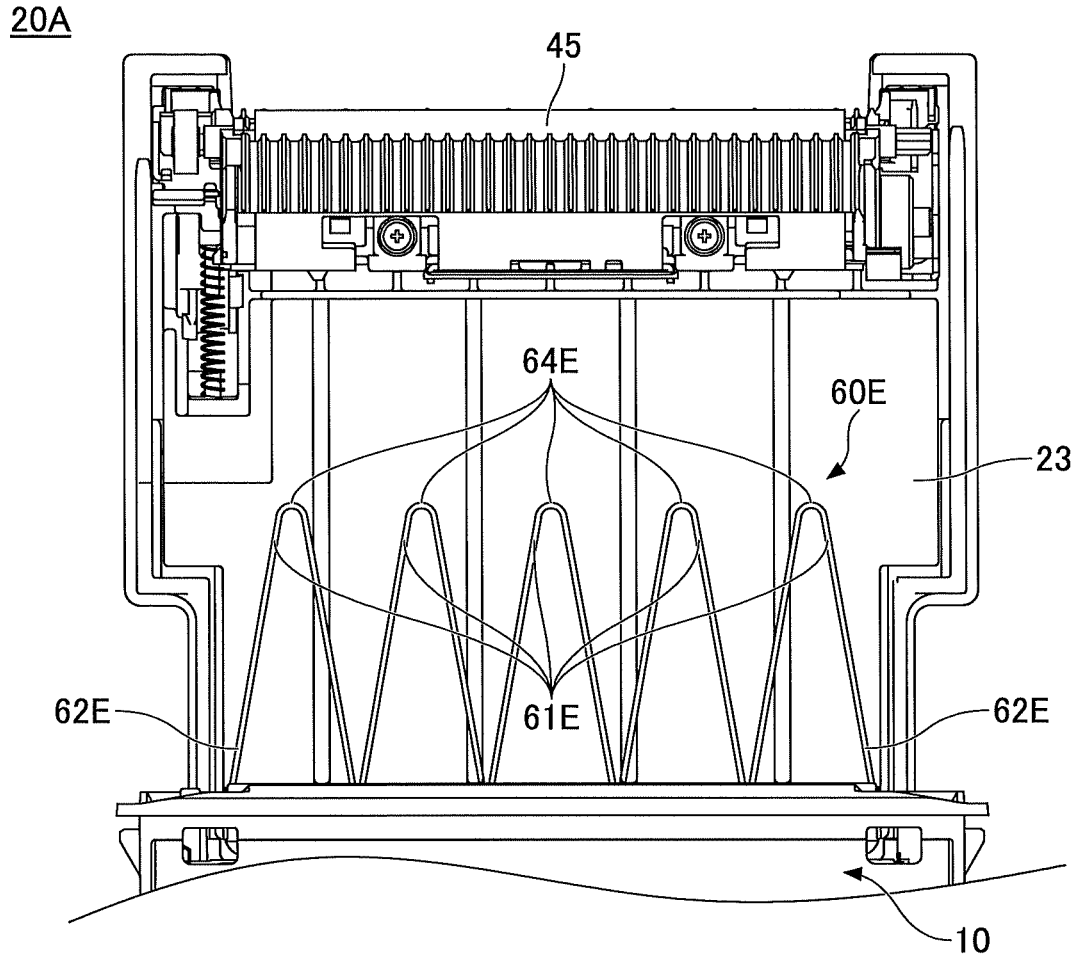
FIG. 21 is a plan view of a printer according to a fifth embodiment.
Figure 22:
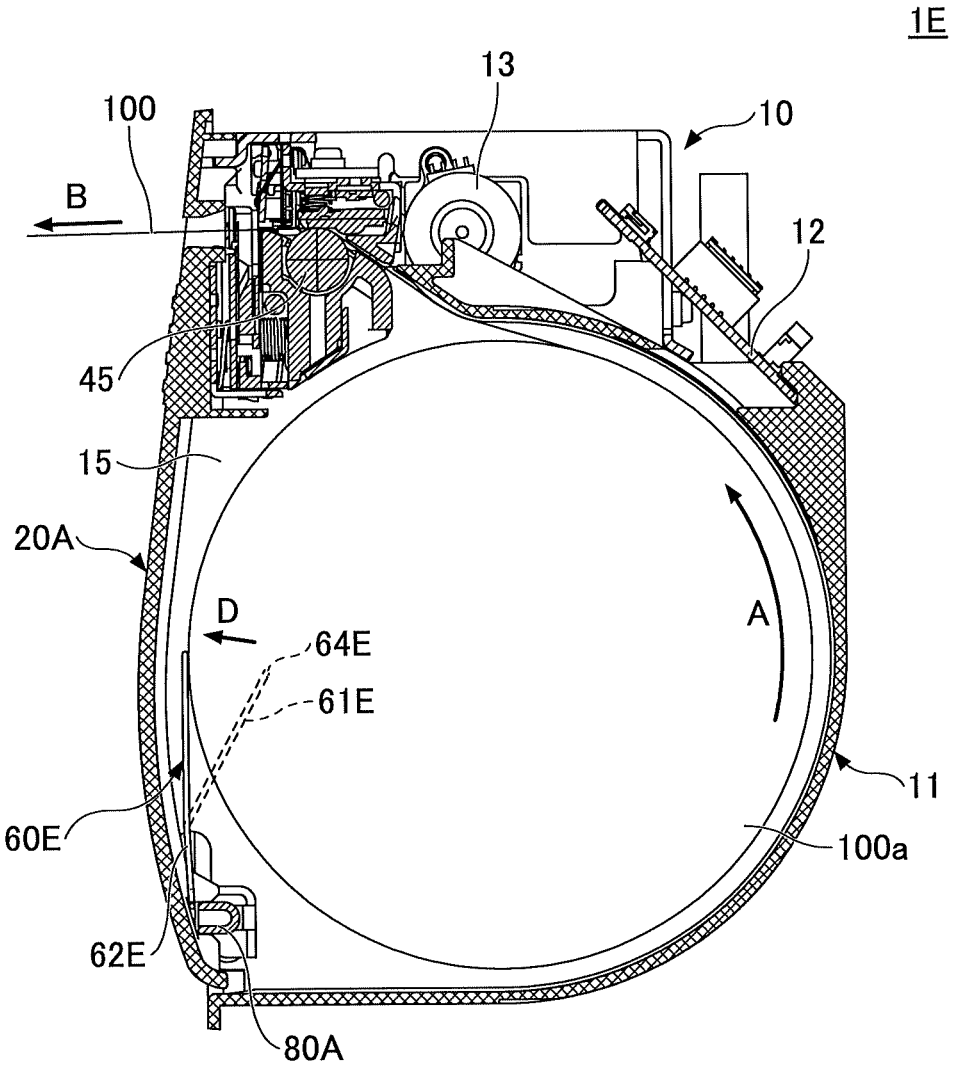
FIG. 22 is a cross-sectional view of a printer whose cover is closed according to the fifth embodiment.

FIGS. 21 and 22 illustrate the printer 1E according to a fifth embodiment. FIG. 21 is a plan view of the cover 20A, and FIG. 22 is a cross-sectional view of the printer 1E with the cover 20A closed.

The printer 1E of the fifth embodiment includes a contact part 60E that includes multiple ("five" in the example of FIG. 21) angled portions 61E. Each angled portion 61E includes a peak portion 64E that protrudes upward, and the ends of the angled portion 61E are attached to the cover 20A. The height of the peak portion 64E is greater than the maximum radius of the paper roll 100*a* placed in the housing chamber 15.

The peak portion 64E of each angled portion 61E may not necessarily protrude upward, and may be configured to protrude downward. Also, the contact part 60E may include angled portions 61E whose peak portions 64E protrude upward as well as angled portions 61E whose peak portions 64E protrude downward.

Also in the fifth embodiment, when the paper roll 100*a* contacts the angled portions 61E, the angled portions 61E are elastically deformed in a direction D (indicated by an arrow D).

Accordingly, the moving force of the paper roll 100*a* is reduced by the elastically-deformed angled portions 61E, and the generation of rubbing sound is reduced.

Also in the fifth embodiment, the angled portions 61E are formed of wires, and substantially point-contact the paper roll 100*a*. Accordingly, the friction between the contact part 60E and the paper roll 100*a* is reduced, and the generation of rubbing sound is reduced.

Also, because the printer 1E includes multiple angled portions 61E, the paper roll 100*a* and the angled portions 61E contact each other at many positions. In the printer 1E, the paper roll 100*a* and the angled portions 61E contact each other at ten positions. This configuration makes it possible to stabilize the paper roll 100*a* even when the recording paper 100 is pulled out at high speed.

Although the number of contact points between the paper roll 100*a* and the contact part 60E is large, the contact area between the paper roll 100*a* and the contact part 60E is smaller than the contact area in the case of a surface contact or a line contact in the comparative example. Accordingly, although the paper roll 100*a* and the angled portions 61E contact each other at many positions, the friction generated at the contact positions is small and the rubbing sound does not increase.

Figure 23:
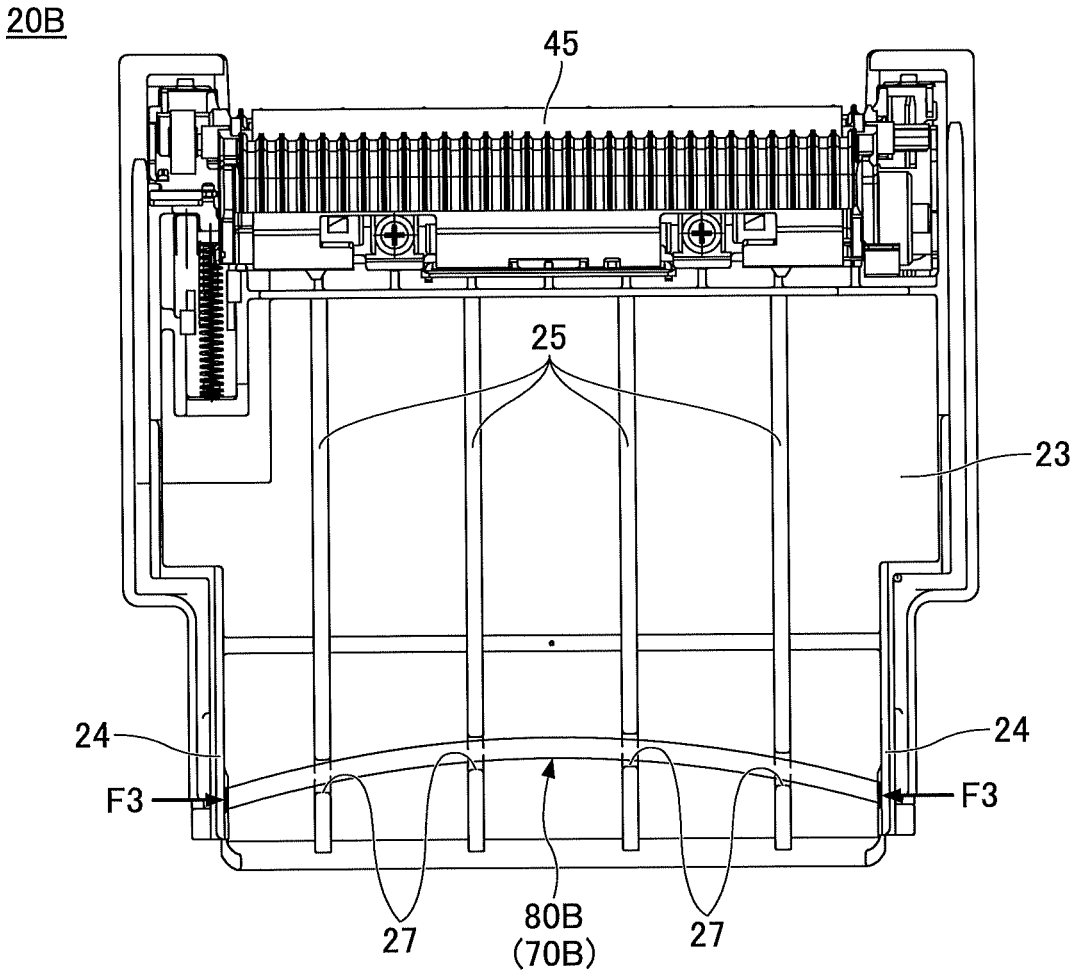
FIG. 23 is a plan view of a printer according to a sixth embodiment.

FIG. 23 is a plan view of a cover 20B including a detachment preventing mechanism 70B of a sixth embodiment.

The detachment preventing mechanism 70B includes an arched stopper 80B. Grooves 27 formed in the cover 20B are also arranged in an arched line that corresponds to the shape of the stopper 80B to be fitted into the grooves 27.

When an external force is applied to the cover 20B and the side plates 24 fall inward, an external force F3 is applied to the ends of the stopper 80B. Because the stopper 80B originally has an arched shape, the stopper 80B is deformed in a predetermined direction when the external force F3 is applied.

Therefore, even when the external force F3 is applied instantaneously to the stopper 80B, the stopper 80B deforms in the predetermined direction and is detached from the cover 20B. Forming the stopper 80B in an arched shape makes it possible to prevent the side plates 24 from being damaged, prevent the stopper 80B from being broken, and prevent the protrusions 82 from being crushed. The inner walls of the grooves 27 contacting the stopper 80B may be inclined so that the stopper 80B can be smoothly detached from the cover 20B.

Figure 24A:
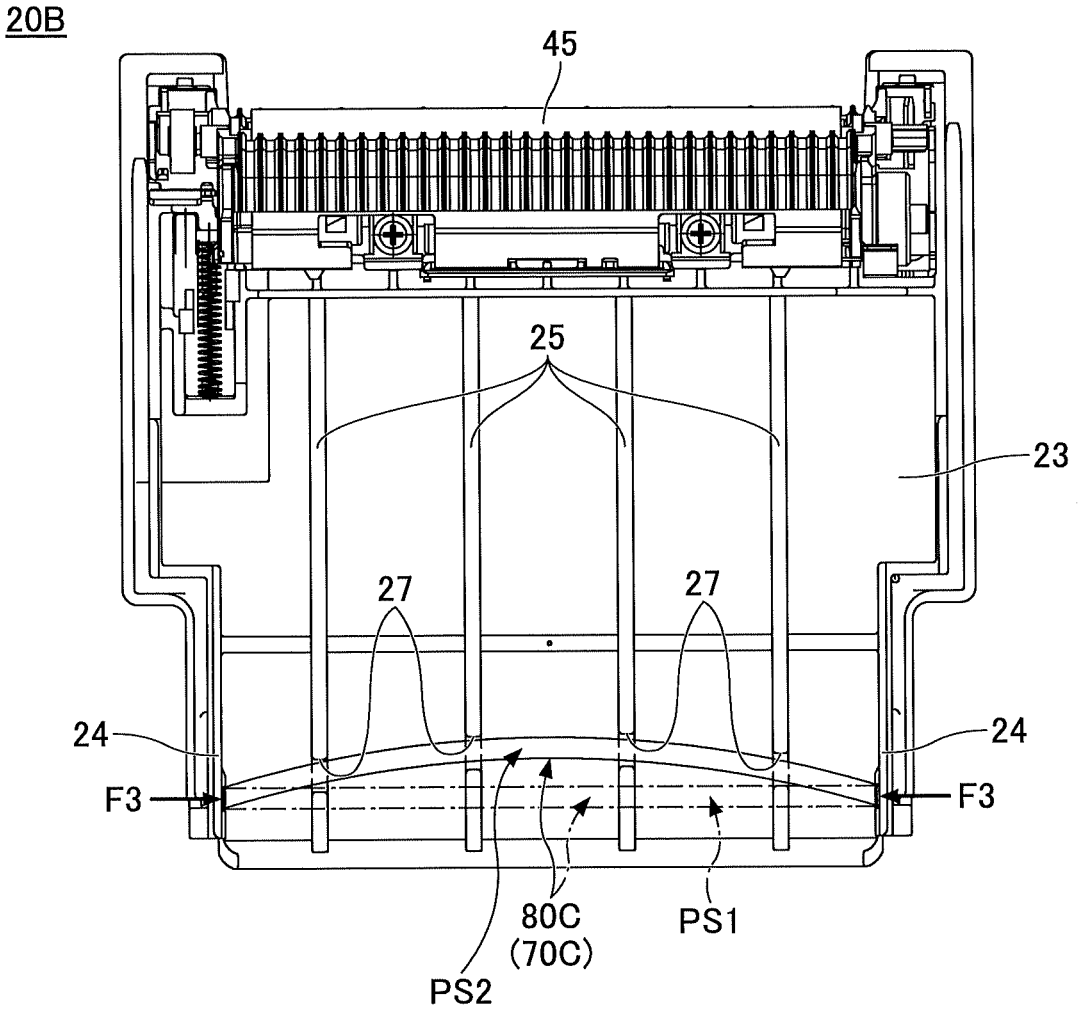
FIG. 24A is a plan view of a printer according to a seventh embodiment.
Figure 24B:
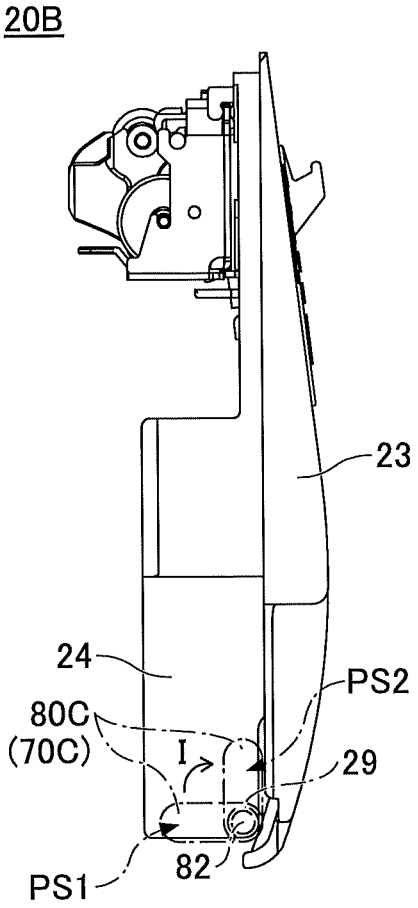
FIG. 24B is a side view of a printer according to the seventh embodiment.

FIGS. 24A and 24B illustrate a cover 20B including a detachment preventing mechanism 70C according to a seventh embodiment. FIG. 24A is a plan view of the cover 20B, and FIG. 24B is a side view of the cover 20B.

The detachment preventing mechanism 70C includes an arched stopper 80C. The grooves 27 formed in the cover 20B are arranged in positions that correspond to the shape of the stopper 80C.

Protrusions 82 formed at the ends of the stopper 80C are rotatably fitted into the recesses 29 formed in the side plates 24. Thus, the stopper 80C is rotatable relative to the cover 20B.

Also in the seventh embodiment, because the stopper 80C originally has an arched shape, the stopper 80C is deformed in a predetermined direction when the external force F3 is applied. Accordingly, when the external force F3 is instantaneously applied, the stopper 80C is detached from the cover 20B. This configuration can prevent the side plates 24 from being damaged, prevent the stopper 80C from being broken, and prevent the protrusions 82 from being crushed.

To attach the stopper 80C to the cover 20B, the protrusions 82 are fitted into the recesses 29 before placing the stopper 80C into the grooves 27. In FIGS. 24A and 24B, an arrow PS1 indicates the stopper 80C that is not placed in the grooves 27, and an arrow PS2 indicates the stopper 80C that is placed in the grooves 27.

With the protrusions 82 fitted into the recesses 29, the stopper 80C is attached to the cover 20B so as to be rotatable about the protrusions 82. Thus, after the stopper 80C is attached to the cover 20B without placing the stopper 80C in the grooves 27 as indicated by the arrow PS1 in FIGS. 24A and 24B, the stopper 80C is rotated in a direction indicated by an arrow I in FIG. 24B to place the stopper 80C in the grooves 27 as indicated by the arrow PS2.

Because the stopper 80C is positioned by coupling the ends of the stopper 80C to the cover 20B, the stopper 80C can be easily placed into the grooves 27 even though the stopper 80C has an arched shape. The configuration of the detachment preventing mechanism 70C of the seventh embodiment makes it possible to easily attach the arched stopper 80C to the cover 20B.

The stopper 80C can be detached from the cover 20B by performing the above process in reverse order. Thus, the stopper 80C can be easily attached to and detached from the cover 20B.

Figure 25:
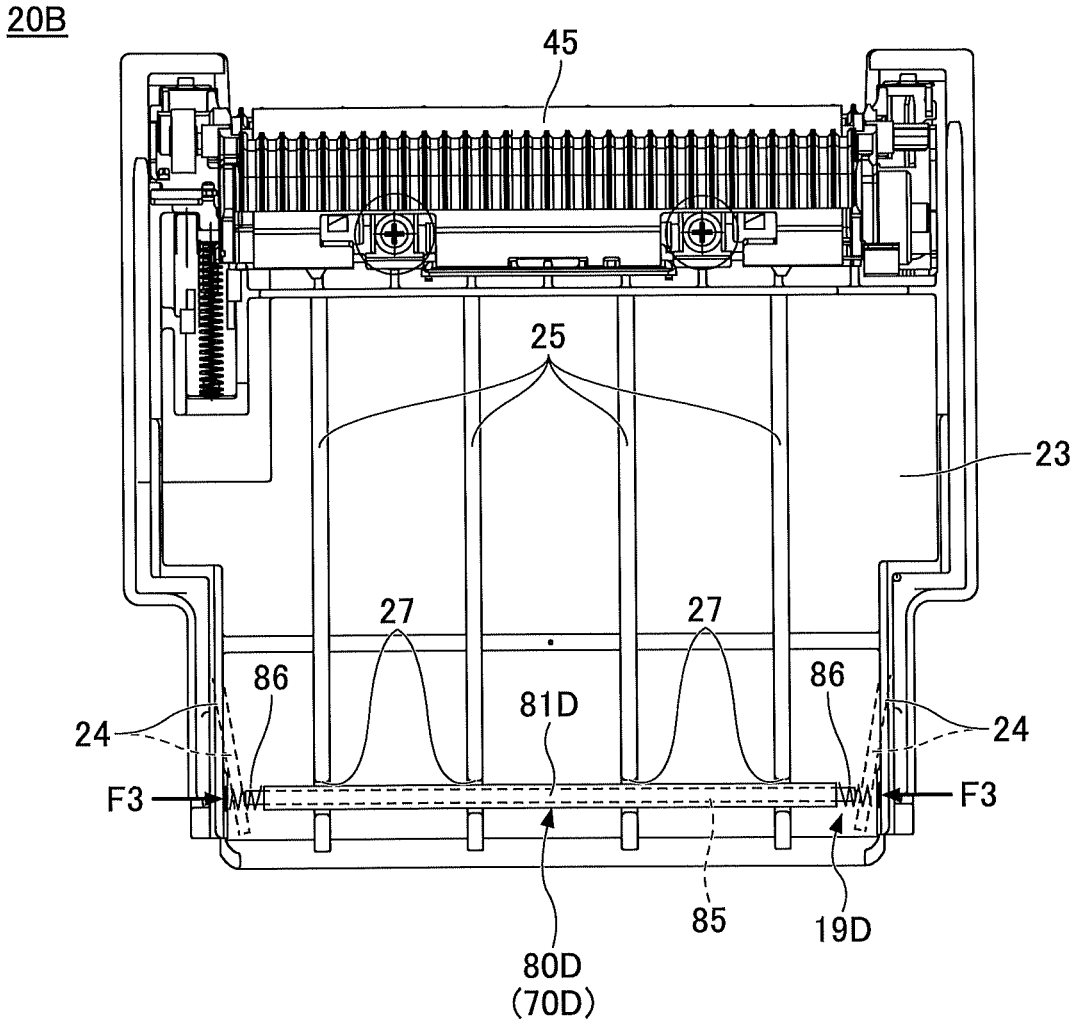
FIG. 25 is a plan view of a printer according to an eighth embodiment.

FIG. 25 is a plan view of a cover 20B including a detachment preventing mechanism 70D according to an eighth embodiment.

A stopper 80D of the detachment preventing mechanism 70D includes a stopper body 81D, a shaft 85, and coil springs 86.

The stopper body 81D has a U-shaped cross section, and extends in the width direction of the cover 20B. A space is formed inside of the stopper body 81D, and the shaft 85 is passed through the space in the stopper body 81D.

The cross-sectional shape of the stopper body 81D is not limited to a U-shape, and the stopper body 81D may have any other cross-sectional shape such as a circular cross-sectional shape as long as the shaft 85 can be passed through the internal space of the stopper body 81D.

The length of the shaft 85 is shorter than the distance between the two side plates 24 indicated by solid lines in FIG. 25. The length of the stopper body 81D is shorter than the length of the shaft 85.

By passing the shaft 85 through the stopper body 81D, the shaft 85 and the stopper body 81D are fixed to each other, and the ends of the shaft 85 protrude from the ends of the stopper body 81D.

The coil springs 86 are attached to portions of the shaft 85 protruding from the stopper body 81D. The inner ends of the coil springs 86 are fixed to the ends of the stopper body 81D by, for example, welding.

When the stopper 80D is attached to the cover 20B, the stopper body 81D is fitted into the grooves 27 formed in the cover 20B. Also, when the stopper 80D is attached to the cover 20B, the outer ends of the coil springs 86 contact the inner walls of the side plates 24.

In the eighth embodiment, when the side plates 24 fall inward as indicated by dotted lines in FIG. 25 and the external force F3 is applied inward to the ends of the stopper 80D, the coil springs 86 contacting the side plates 24 are compressed.

In the eighth embodiment, the coil springs 86 are compressed when the external force F3 is applied, and damage to the side plates 24 and the stopper 80D is thereby prevented.

Embodiments of the present invention are described above. However, the present invention is not limited to the specifically disclosed embodiments, and variations and modifications may be made without departing from the scope of the present invention.

The present application is based on and claims the benefit of priority of Japanese Patent Application No. 2015-058726 filed on Mar. 20, 2015, the entire contents of which are hereby incorporated herein by reference.

EXPLANATION OF REFERENCE NUMERALS

1A-1E Printer
11 Holder
15 Housing chamber
17 Shaft hole
20A, 20B Cover
23 Cover body
24 Side plate
25 Rib
26 Protrusion
27 Groove
50 Bearing
29 Recess
50 Coupling mechanism
70A-70D Detachment preventing mechanism
80A-80D Stopper
82 Protrusion
83 Stopper surface
85 Shaft
86 Coil spring

The invention claimed is:

1. A printer, comprising:

a printer body including a holder configured to house rolled recording paper;

a cover configured to open and close the holder;

a coupling mechanism that couples the cover to the printer body; and a detachment preventing mechanism configured to prevent the cover from being detached from the printer body, wherein the coupling mechanism includes shafts formed on one of side plates of the cover and inner walls of the printer body, and shaft holes formed in another one of the side plates and the inner walls and configured to receive the shafts; and the detachment preventing mechanism includes a stopper that is disposed such that ends of the stopper contact inner surfaces of the side plates and configured to support the side plates and prevent the side plates from falling when a load is applied to the cover.

2. The printer as claimed in claim 1, wherein the stopper is attached to grooves formed in the cover.

3. The printer as claimed in claim 1, wherein the stopper has an arched shape.

4. The printer as claimed in claim 1, wherein the stopper is rotatable relative to the cover.

* * * * *